US006893809B2

(12) United States Patent
Reed et al.

(10) Patent No.: US 6,893,809 B2
(45) Date of Patent: May 17, 2005

(54) SILVER HALIDE PHOTOGRAPHIC ELEMENT CONTAINING FOGGED EMULSIONS FOR ACCELERATED DEVELOPMENT

(75) Inventors: Kenneth J. Reed, Rochester, NY (US); James A. Friday, Rochester, NY (US); John E. Keevert, Rochester, NY (US); Stephen P. Singer, Spencerport, NY (US); Mary C. Brick, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 182 days.

(21) Appl. No.: 10/244,569

(22) Filed: Sep. 16, 2002

(65) Prior Publication Data

US 2004/0063048 A1 Apr. 1, 2004

(51) Int. Cl.[7] ..... G03C 1/46

(52) U.S. Cl. ..... 430/505; 430/546; 430/549; 430/551; 430/552; 430/955; 430/567; 430/506; 430/569

(58) Field of Search ..... 430/505, 506, 430/567, 569, 546, 549, 551, 552, 955

(56) References Cited

U.S. PATENT DOCUMENTS

| | | | | |
|---|---|---|---|---|
| 4,082,553 A | | 4/1978 | Groet | |
| 4,482,629 A | | 11/1984 | Nakagawa et al. | |
| 4,554,245 A | * | 11/1985 | Hayashi et al. | 430/567 |
| 4,618,572 A | | 10/1986 | Mihayashi et al. | |
| 4,656,122 A | | 4/1987 | Sowinski et al. | |
| 4,820,616 A | | 4/1989 | Matejec et al. | |
| 4,859,578 A | | 8/1989 | Michno et al. | |
| 4,912,025 A | | 3/1990 | Platt et al. | |
| 5,399,466 A | | 3/1995 | Hamer | |
| 5,605,786 A | | 2/1997 | Saito et al. | |
| 6,110,657 A | | 8/2000 | Lunt et al. | |
| 6,114,103 A | * | 9/2000 | Friday et al. | 430/955 |
| 6,162,595 A | | 12/2000 | Chen | |
| 6,350,564 B1 | * | 2/2002 | Bringley et al. | 430/502 |
| 6,416,941 B1 | * | 7/2002 | Reed et al. | 430/599 |
| 6,426,180 B1 | * | 7/2002 | Bringley et al. | 430/614 |
| 2003/0175628 A1 | * | 9/2003 | Gordon et al. | 430/448 |

OTHER PUBLICATIONS

U.S. Appl. No. 10/244,270, of John E. Keevert et al., "Photographic Recording Material For Accelerated Development".

* cited by examiner

*Primary Examiner*—Geraldine Letscher
(74) *Attorney, Agent, or Firm*—Sarah Meeks Roberts

(57) ABSTRACT

This invention relates to a negative silver halide photographic element comprising a support and a silver halide imaging layer containing a light sensitive silver halide imaging emulsion, said silver halide imaging layer further comprising a separately precipitated non-imaging intentionally fogged fine grain emulsion and an electron transfer agent releasing compound represented by formula (I):

$$CAR^1\text{-}(L)_n\text{-}ETA \qquad (I)$$

wherein:

$CAR^1$ is a carrier moiety which is capable of releasing $\text{-}(L)_n\text{-}ETA$ on reaction with oxidized developing agent;

L is a divalent linking group, n is 0, 1 or 2; and

ETA is a releasable electron transfer agent, and (optionally) a development accelerator releasing compound represented by the formula (II):

$$CAR^2\text{—}(SAM)\text{-}NX^1\text{—}NX^2X^3 \qquad (II)$$

wherein:

$CAR^2$ is a carrier moiety which is capable of releasing $\text{—}(SAM)\text{-}NX^1\text{—}NX^2X^3$ on reaction with oxidized developing agent;

SAM is a silver absorbable moiety attached to the carrier moiety and is released on reaction with oxidized development agent; and $\text{—}NX^1\text{—}NX^2X^3$ is a hydrazine group wherein $X^1$, $X^2$ and $X^3$ are individually hydrogen or a substituent chosen from alkyl, aryl, carbonyl, or sulfonyl groups with the proviso that at least one of $X^1$, $X^2$ and $X^3$ is hydrogen.

33 Claims, No Drawings

SILVER HALIDE PHOTOGRAPHIC ELEMENT CONTAINING FOGGED EMULSIONS FOR ACCELERATED DEVELOPMENT

FIELD OF THE INVENTION

This invention relates to a silver halide photographic element containing a fine-grain fogged emulsion in combination with a compound that releases an electron transfer agent (ETARC) and a compound that releases a specific type of development accelerating agent (DARC) for improved photographic imaging. The ETARC compound releases an electron transfer agent (ETA) and the DARC compound releases a development accelerating fragment upon reacting with oxidized developing agent.

BACKGROUND OF THE INVENTION

The sensitivity of widely used silver halide photographic materials has increased over the years from an ISO sensitivity of 100 to an ISO sensitivity of greater than 1000. Emulsions containing large silver halide grains, which give greater sensitivity to light, may be used to increase speed; however, such emulsions usually also increase granularity. In addition, certain silver halide emulsions are relatively more difficult to develop depending upon their particular physical or chemical properties. For example, silver halide emulsions with large grains or silver halide grains having a relatively high iodide content, generally develop at slower rates than emulsions having smaller grains or a low iodide content. The preferred emulsions of this invention, i.e. "low-fogging" emulsions are also much slower to develop due to their relative absence of native fog centers and exhibit longer development induction times (the period before noticeable development occurs).

One way of achieving higher speeds in emulsions is to promote chemical development. Different methods to accelerate development of exposed silver halide grains have been realized. For example, U.S. Pat. No. 6,110,657 describes the release of improved types of electron transfer agents (ETA)s of limited diffusibility for development acceleration without an increase in 'wrong-way' interimage. These types of compounds are commonly referred to as electron transfer agent releasing couplers or (ETARC)s. As another example, U.S. Pat. No. 5,605,786 describes a method of imagewise release of an ETA where an —O—CO-$(T)_n$-(ETA) group is attached at the coupling-off site of the ETARC. U.S. Pat. Nos. 4,859,578 and 4,912,025 describe silver halide elements comprising a development inhibitor releasing compound and a compound capable of imagewise releasing an electron transfer agent.

It is also known that couplers that release other types of development accelerating fragments can be used to achieve increased photographic speed. In particular, it is known that compounds that release hydrazine derivatives upon reaction with oxidized developer are effective development accelerator releasing couplers or (DARC)s. For example, U.S. Pat. Nos. 4,482,629; 4,820,616; and 4,618,572 all describe the use of DARCs that release hydrazine derivatives, including those in which the hydrazine derivative also bears a silver absorbable moiety.

Fogged grain emulsion technology has had some limited application as a component in multilayer films, primarily in the area of Kodak Ektachrome color reversal films. The role of the fogged grains is to fully develop in the first developer (black and white) and provide a silver ion source for solution physical development (SPD). Increasing the SPD both enhances the shoulder speed and contributes to the sharpening of the reversal toe-both highly desirable effects. Fogged grains can also be used to control interlayer image effects (color correction effects) when they are coated in a receiver layer (one which is influenced by development in another color record) as described in U.S. Pat. Nos. 4,082,553, 4,656,122 describes a reversal element including a blended emulsion layer containing a non-imaging fine-grained emulsion. U.S. Pat. No. 5,399,466 describes the combined effect upon interimage when both fogged grains and development inhibiting releasing couplers are used in reversal films.

In spite of all of the efforts in the industry, however, there is still a continuing need for methods of improving the photographic speed of silver halide emulsions without compromising other performance features of the photographic element.

SUMMARY OF THE INVENTION

This invention provides a negative silver halide photographic element comprising a support and a silver halide imaging layer containing a light sensitive silver halide imaging emulsion, said silver halide imaging layer further comprising a separately precipitated non-imaging intentionally fogged fine grain emulsion and an electron transfer agent releasing compound represented by formula (I):

$$CAR^1\text{-}(L)_n\text{-}ETA \quad (I)$$

wherein:

$CAR^1$ is a carrier moiety which is capable of releasing -$(L)_n$-ETA on reaction with oxidized developing agent;

L is a divalent linking group, n is 0, 1 or 2; and

ETA is a releasable electron transfer agent. Optionally, the imaging layer may also contain a development accelerator releasing compound represented by the formula (II):

$$CAR^2\text{—}(SAM)\text{-}NX^1\text{—}NX^2X^3 \quad (II)$$

wherein:

$CAR^2$ is a carrier moiety which is capable of releasing —(SAM)-$NX^1$—$NX^2X^3$ on reaction with oxidized developing agent;

SAM is a silver absorbable moiety attached to the carrier moiety and is released on reaction with oxidized development agent; and —$NX^1$—$NX^2X^3$ is a hydrazine group wherein $X^1$, $X^2$ and $X^3$ are individually hydrogen or a substituent chosen from alkyl, aryl, carbonyl or sulfonyl groups with the proviso that at least one of $X^1$, $X^2$ and $X^3$ is hydrogen.

This invention provides a silver halide photographic element which exhibits an improved photographic speed-grain position without compromising other performance features of the photographic element. Both ETARCs and DARCs need to react with oxidized developer to release their respective reactive moieties, ETAs and hydrazine nucleators. Inclusion of a low-level of fine-grain fogged emulsion can provide an initial early release of $D^{ox}$ to start the chemistries reacting and thereby compensate for the slow development of certain emulsions, particularly "low fogging" emulsions. The improvements in photographic speed-grain in color film elements are unexpectedly synergistic.

DETAILED DESCRIPTION OF THE INVENTION

The silver halide grains of the fogged fine grain emulsion utilized in the invention are intentionally surface fogged.

The surface-fogged silver halide grains may be prepared by 1) adding a reducing agent or a gold salt to an emulsion capable of forming a surface latent image under appropriate pH and pAg conditions, 2) heating an emulsion capable of forming a surface latent image under a high pH or low pAg condition, or 3) uniformly exposing an emulsion capable of forming a surface latent image to light. All of these methods are known to those skilled in the art. Examples of suitable reducing agents are various thioureas, amine boranes, stannous chloride, hydrazine compounds, and ethanolamine. A typical fogging agent that is commonly used is thiourea dioxide (aminoiminomethanesulfinic acid) The choice of fogging agent is not critical; however, care should be taken so as not to leave any unreacted or excess reagent present in the fine grain emulsion which could then subsequently fog the imaging emulsion. The grains may also be surface fogged by heating at high pH (e.g., pH>6.5) and or low pAg (e.g., 2<pAg<5) or both. See H. W. WOOD, J. Photogr. Science, 1, 163 (1953). It is highly desirable that all grains in the population be fogged to a sufficient extent that they develop fully and rapidly.

The fogged fine silver halide grains utilized in the invention will typically have an average mean particle size (that is, an average equivalent circular diameter of the projected area) of between 0.03 $\mu$m to 0.5 $\mu$m, and preferably between 0.05 $\mu$m to 0.2 $\mu$m. The fine fogged grain emulsion is generally appreciably smaller than the imaging emulsion, generally having a size ratio of 1:2 or less (fogged fine grain: imaging emulsion). The fine fogged grains are preferably small enough and in low enough concentration to not contribute to the granularity signal. Further, they are chosen to have a high molar surface area to cause the rapid release of Dox: The fogged grains may be of any silver halide composition, including but not limited to silver bromide, silver bromoiodide, silver chloride, silver chlorobromide, silver chloroiodide, and silver chlorobromoiodide, and preferably have a molar iodide content of less than 15%. In one suitable embodiment the fogged grains are bromoiodide.

The fogged fine silver halide emulsions can contain grains of any morphology. Thus, the grains may take the form of cubes, octahedrons, cubo-octahedrons, or any of the other naturally occurring morphologies of cubic lattice type silver halide grains. Further, the grains may be irregular such as spherical grains or tabular grains. The amount of fine fogged grain emulsion that is used is typically between 0.05% to 0.5%, and preferably no more than 0.1%, by weight of the imaging silver halide emulsion in the same layer. The fine fogged grain silver halide emulsion is a non imaging emulsion; that is, the emulsion grain population is not measurably changed by exposure to light to which the imaging layer is sensitive.

The fogged fine grains are contained in an imaging layer, i.e., a layer also containing an imaging light sensitive silver halide emulsion which is intended to be exposed to form a latent image. The fogged fine grains are contained in an emulsion that is separately precipitated from the imaging light sensitive silver halide emulsion. The imaging layer may be one of a number of sub-layers, for example, sub layers of an image dye-forming unit each having a different sensitivity to light. The imaging layer may contain one or more imaging light sensitive silver halide emulsions. The fine fogged grain emulsion may be contained in just one imaging layer or more than one imaging layer of the silver halide element. For example, the fine fogged grain emulsion may be contained in all or some of the imaging layers of an image dye forming unit. When the dye forming unit contains more than one layer and the layers have different sensitivities to light, the fine fogged grain emulsion is preferably contained in the layer having the highest sensitivity to light (i.e., the fastest layer).

It is generally most convenient to prepare the emulsions required for the practice of this invention by blending an imaging silver halide emulsion, preferably after sensitization, and a separately prepared (precipitated) emulsion containing the fine fogged non imaging emulsion grain population. The fine fogged grain silver halide emulsion can, for example, be prepared by various methods which are well known to those skilled in the art. The fine fogged grain silver halide emulsion population can comprise, for example, Lippmann emulsions, fine cubic emulsions, or fine tabular grain emulsions.

The silver halide imaging layer also contains at least one electron transfer agent releasing compound (ETARC). The ETARC releases an electron transfer agent. The term "electron transfer agent" or ETA is employed in its art recognized sense of denoting a silver halide developing agent that donates an electron (becomes oxidized) in reducing Ag+in silver halide to silver Ag° and is then regenerated to its original non-oxidized state, preferably by entering into a redox reaction with primary amine color developing agent.

The ETARCs utilized in the photographic elements of the invention are represented by the following formula (I)

$$CAR^1\text{-}(L)_n\text{-}ETA \qquad I$$

In the above formula $CAR^1$ is a carrier moiety which is capable of releasing -$(L)_n$-ETA" on reaction with oxidized developing agent. L is a divalent linking group and n is 0, 1 or 2. ETA is an electron transfer agent, preferably a 1 aryl-3-pyrazolidinone derivative, attached to L which upon release from L is unblocked and becomes an active electron transfer agent capable of accelerating development under processing conditions used to obtain the desired dye image. Some suitable ETARCs of the above formula are described in detail in U.S. Pat. No. 6,416,941 incorporated herein by reference.

The electron transfer agent pyrazolidinones that have been found to be useful in providing development increases are derived from compounds generally of the type described in U.S. Pat. Nos. 4,209,580; 4,463,081; 4,471,045; and 4,481,287 and in published Japanese Patent Application Serial No. 62-123172, all incorporated herein by reference. Such compounds comprise a 3-pyrazolidinone structure having an unsubstituted or a substituted aryl group in the 1-position. Preferably these compounds have one or more alkyl groups in the 4- or 5-positions of the pyrazolidinone ring.

Preferably ETA is a 1-aryl-3-pyrazolidinone derivative having a calculated log partition coefficient (c log P) greater than or equal to 2.40, using MedChem v3.54 (Medicinal Chemistry Project, Pomona College, Claremont, Calif., 1987). The sum total of the Hammett sigma(para) values of all of the substituents on the 1-aryl ring must be 0.51 or less. The ETA is released from -$(L)_n$- and becomes an active electron transfer agent capable of accelerating development under processing conditions used to obtain the desired dye image.

On reaction with oxidized developing agent during processing, the $CAR^1$ moiety releases the -$(L)_n$-ETA fragment which is capable of releasing an electron transfer agent. The electron transfer agent participates in the color development process to increase the rate of silver halide reduction and color developer oxidation resulting in enhanced detection of exposed silver halide grains and the consequent improved image dye density. If the ETA is too mobile, it can diffuse into other layers from where it was originally released and cause increased development in those layers. This results in wrong-way interimage and a decrease in color saturation and purity. The ETA utilized in the invention has a calculated log partition coefficient (c log P) greater than or equal to 2.40 as described above which reduces mobility. However, in some instances the ETA may not be mobile enough to interact efficiently with the developed silver and developer and, hence, it is preferred that the c log P of the ETA fragment be no more than 5.0, or more preferably, no more than 4.0, or most preferably, 3.40 or less. Moreover, if the ETA contains substituents with a sum total of Hammett sigma(para) values of greater than 0.51, then the reduction potential of the ETA fragment becomes too low to interact effectively with silver development and/or developer oxidation.

Preferred electron transfer agents suitable for use in this invention are represented by structural formulas Ia and Ib:

Ia

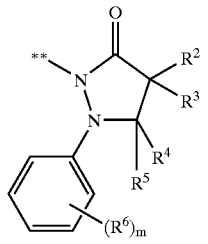

Ib

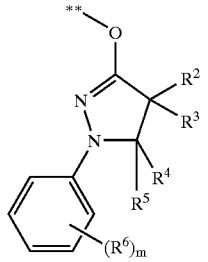

**denotes point of attachment to $CAR^1$—$(L)_n$—;

$R^2$ and $R^3$ each independently represents hydrogen, a substituted or unsubstituted alkyl group having from 1 to 12 carbon atoms, $CH_2OR^7$ or $CH_2OC(O)R^7$ where $R^7$ can be a substituted or unsubstituted alkyl, aryl or a heteroatom containing group, $CH_2SR^7$, or $CH_2N(R^{7a})(R^{7b})$ wherein $R^{7a}$ or $R^{7b}$ each independently represents hydrogen, or a substituted or unsubstituted alkyl or aryl group. When $R^2$ and $R^3$ are alkyl, $CH_2OR^7$ or $CH_2OC(O)R^7$ groups, and $R^7$ is a substituted or unsubstituted alkyl or aryl group, it is preferred that $R^2$ and $R^3$ comprise from 3 to 8 carbon atoms. When $R^7$ is a heteroatom containing group, it is preferred that $R^2$ and $R^3$ comprise from 4 to 12 carbon atoms. $R^7$ may contain, for example, a morpholino, imidazole, triazole or tetrazole group, or a sulfide or ether linkage.

$R^4$ and $R^5$ each independently represents hydrogen, a substituted or unsubstituted alkyl group having from 1 to 8 carbon atoms, or a substituted or unsubstituted aryl group having from 6 to 10 carbon atoms. Preferably $R^4$ and $R^5$ each represents hydrogen. It is also possible that $R^3$ and $R^4$ may be joined by the necessary atoms to together form a 5- or 6-membered carboxylic or heterocyclic ring system.

$R^6$, which may be present in the ortho, meta or para positions of the aromatic ring, is any substituent which does not interfere with the required log partition coefficient or the functionality of the ETA and meets the requirement that the sum total of all of the Hammett sigma(para) coefficients is 0.51 or less. Hammett sigma(para) values are as described in *Substituent Constants for Correlation Analysis in Chemistry and Biology*, C. Hansch and A. J. Leo, Wiley & Co, New York, 1979. In one embodiment $R^6$ independently represents hydrogen, halogen, a substituted or unsubstituted alkyl group having from 1 to 8 carbon atoms, a substituted or unsubstituted alkoxy group having from 1 to 8 carbon atoms, a substituted or unsubstituted alkylthio group having 1 to 8 carbon atoms, amido (—NHCO—), sulfonamido (—$NHSO_2$—), or a heteroatom containing group or ring. Preferably $R^6$ is hydrogen, halogen, a substituted or unsubstituted alkyl group having from 1 to 8 carbon atoms, or a substituted or unsubstituted alkoxy group having from 1 to 8 carbon atoms. m is 0 to 5. Specific $R_6$ substituents that are not part of this invention are nitro, cyano, sulfonyl, and sulfamoyl (—$SO_2N$<). When m is greater than 1, the $R^6$ substituents can be the same or different or can be taken together to form a carbocyclic or heterocyclic ring.

Especially preferred releasable electron transfer agents, suitable for use in this invention, are presented in Table I, with $R^4$ and $R^5$ being hydrogen:

TABLE I

| ETA No. | $R^2$ | $R^3$ | $R^6$ | C log P |
|---|---|---|---|---|
| 1 | $CH_3$ | $CH_2OC(O)C_3H_7$-i | H | 2.5 |
| 2 | $CH_3$ | $CH_2OC(O)tBu$ | H | 2.9 |
| 3 | $CH_3$ | $CH_2OC(O)C_3H_7$-n | p-$CH_3$ | 3.2 |
| 4 | $CH_3$ | $CH_2OC(O)C_2H_5$ | 3,4-dimethyl | 3.0 |
| 5 | $CH_3$ | $CH_2OCOCH_2C_6H_5$ | p-$OCH_3$ | 3.3 |
| 6 | $CH_3$ | $CH_2OC(O)CH_2$—O—$(CH_2)_2S(CH_2)_2SCH_3$ | H | 2.7 |
| 7 | H | $CH_2OC(O)C_4H_9$-n | H | 2.6 |
| 8 | H | $CH_2OC_4H_9$-n | p-OCH3 | 2.4 |
| 9 | $CH_3$ | $CH_2OC(O)C_3H_7$-I | p-CH3 | 3.2 |
| 10 | $CH_3$ | 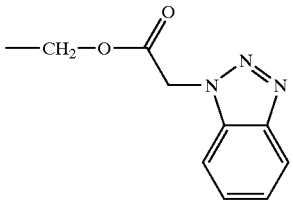 | H | 2.7 |

The amount of ETARC and DARC that can be employed with this invention can be any concentrations that are effective for the intended purpose. A possible concentration range for the ETARC is from 6 $\mu$mole/$m^2$ to 1000 $\mu$mole/$m^2$. A preferred concentration range is 20 $\mu$mole/$m^2$ to 140 $\mu$mole/$m^2$. A possible concentration range for the DARC is from 0.1 $\mu$mole/$m^2$ to 25 $\mu$mole/$m^2$. A preferred concentration range is 0.5 $\mu$mole/$m^2$ to 10 $\mu$mole/$m^2$.

The ETA is attached to the carrier at a position that will cause the ETA to be inactive until released. If ETA is a pyrazolidinine, the point of attachment of the ETA to the $CAR^1$ or to the $CAR^1$-$(L)_n$-linking is through either the nitrogen atom in the 2-position or the oxygen attached to the 3-position of the pyrazolidinone ring as shown for structures Ia or Ib. Such attachment inactivates the ETA so that it is unlikely to cause undesirable reactions during storage of the photographic material. However, the oxidized developer formed in an imagewise manner as a consequence of silver halide development reacts with the $CAR^1$ moiety to lead to the cleavage of the bond between the CAR and L. L undergoes further reaction to release the active ETA moiety.

The linking group -$(L)_n$- is employed to provide for controlled release of the ETA moiety from the coupler moiety so that the effect of accelerated silver halide development can be quickly attained. L represents a divalent linking group which is both a good leaving group and which allows release of the ETA without a long delay. n is 0, 1, or 2. Various types of known linking groups can be used. These include quinone methide linking groups such as are disclosed in U.S. Pat. No. 4,409,323; pyrazolonemethide linking groups such as are disclosed in U.S. Pat. No. 4,421,845; —O—CO-$(T)_n$- groups such as are disclosed in U.S. Pat. No. 5,605,786, and intramolecular nucleophillic displacement type linking groups such as are disclosed in U.S. Pat. No. 4,248,962. In one suitable embodiment L is a group which forms the following $CAR^1$-$(L)_n$-ETA structures:

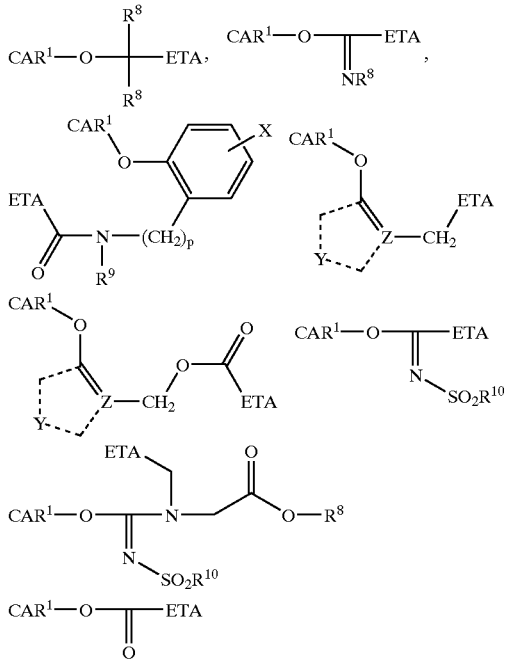

wherein each $R^8$ can independently be hydrogen, a substituted or unsubstituted alkyl group of 1 to 12 carbon atoms or a substituted or unsubstituted aryl group of 6 to 10 carbon atoms. More preferably $R^8$ is a substituted or unsubstituted alkyl group of 1 to 4 carbon atoms. $R^9$ is a substituted or unsubstituted alkyl group of from 1 to 20 carbon atoms, preferably of from 1 to 4 carbon atoms, or a substituted or unsubstituted aryl group of from 6 to 20 carbon atoms, preferably of from 6 to 10 carbon atoms. X is an —$NO_2$, —CN, sulfone, sulfamoyl (i.e., —$SO_2N$<), sulfonamido (i.e., —$NHSO_2$—), halogen or alkoxycarbonyl group and p is 0 or 1.

Y represents the atoms necessary to form is a substituted or unsubstituted carbocyclic aromatic ring, or a substituted or unsubstituted heterocyclic aromatic ring. Preferably Y forms a carbocyclic aromatic ring having 6 to 10 carbon atoms or a 5-membered heterocyclic aromatic ring. Suitable heterocyclic rings include pyrazoles, imidazoles, triazoles, pyrazolotriazoles, etc. $R^{10}$ is a substituted or unsubstituted alkyl or aryl group. Z is a carbon or nitrogen atom.

Particularly suitable linking groups are shown by the formulas below:

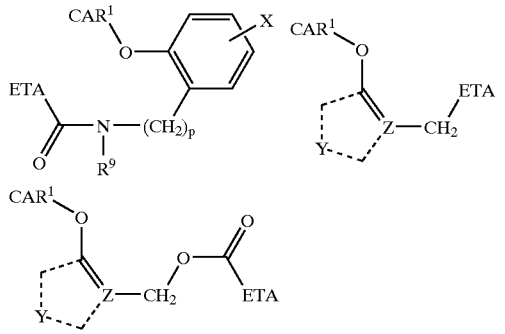

wherein Y represents the atoms necessary to form a substituted or unsubstituted phenyl ring, Z is a carbon atom, and $R^9$ and p are as defined above. Typical useful linking groups include:

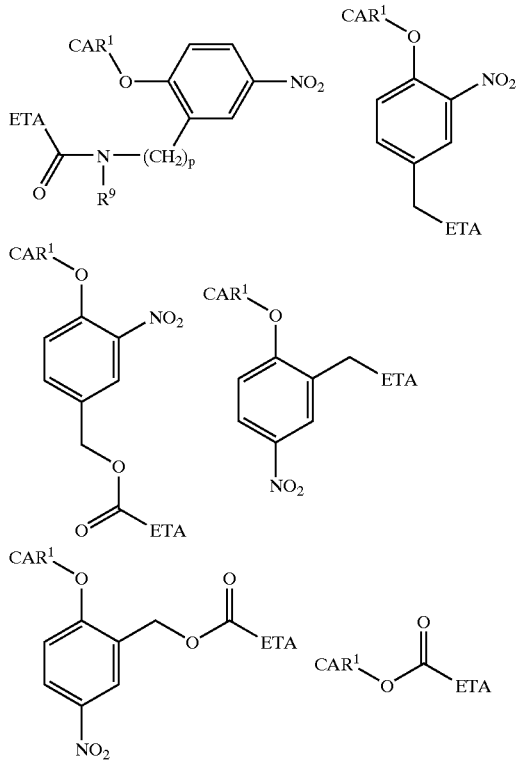

where $R^9$ is as defined above and p is 0 or 1.

CAR of $CAR^1$ and $CAR^2$ is a carrier moiety that is capable of releasing for ETARCs, the -$(L)_n$-ETA moiety, or in the case of DARCs, the —(SAM)-$NX^1$—$NX^2X^3$ moiety, upon reaction with oxidized developing agent. In a preferred embodiment, CAR is a coupler moiety that can release -$(L)_n$-ETA or —(SAM)-$NX^1$—$NX^2X^3$ from the coupling site during reaction with oxidized primary amine color developing agent. CAR carriers that are triggered by reaction with oxidized developing agent are capable of releasing a photographically useful group (PUG) and are particularly well known in development inhibitor release (DIR) technology where the PUG is a development inhibitor. Typical references to hydroquinone type carriers are U.S. Pat. Nos. 3,379,529; 3,297,445; and 3,975,395. U.S. Pat. No. 4,108,663 discloses similar release from aminophenol and aminonaphthol carriers, while U.S. Pat. No. 4,684,604 features PUG-releasing hydrazide carriers. All of these may be classified as redox-activated carriers for PUG release.

A far greater body of knowledge has been built up over the years on carriers in which a coupler releases a PUG upon condensation with an oxidized primary amine color developing agent. These can be classified as coupling-activated carriers. Representative are U.S. Pat. Nos. 3,148,062; 3,227,554; 3,617,291; 3,265,506; 3,632,345; and 3,660,095.

The coupler from which the electron transfer agent pyrazolidinine moiety or the development accelerator fragment is released includes couplers employed in conventional color-forming photographic processes that yield colored products based on reactions of couplers with oxidized color developing agents. The couplers can also yield colorless products on reaction with oxidized color developing agents. The couplers can also form dyes that are unstable and which decompose into colorless products. Further, the couplers can provide dyes that wash out of the photographic recording materials during processing. Such couplers are well known to those skilled in the art.

The coupler can be unballasted or ballasted with an oil-soluble or fat-tail group. It can be monomeric, or it can form part of a dimeric, oligomeric, or polymeric coupler, in which case more than one ETA moiety or development accelerator fragment can be contained in the ETARC or DARC compound.

Many coupler kinds are known. The dyes formed therefrom generally have their main absorption in the red, green, or blue regions of the visible spectrum. For example, couplers which form cyan dyes upon reaction with oxidized color developing agents are described in such representative patents and publications as U.S. Pat. Nos. 2,772,162; 2,895,826; 3,002,836; 3,034,892; 2,474,293; 2,423,730; 2,367,531; 3,041,236; and 4,333,999; and "Farbkuppler: Eine Literaturubersicht," published in Agfa Mitteilungen, Band III, pp. 156–175 (1961). In the coupler structures shown below, the unsatisfied bond indicates the coupling position to which -$(L)_n$-ETA or —(SAM)-$NX^1$—$NX^2X^3$ group may be attached.

Preferably such couplers are phenols and naphthols that give cyan dyes on reaction with oxidized color developing agent at the coupling position, i.e., the carbon atom in the 4-position of the phenol or naphthol. Structures of such preferred cyan couplers are:

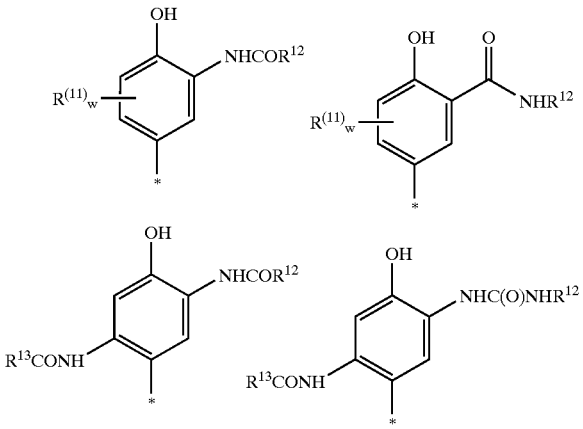

-continued

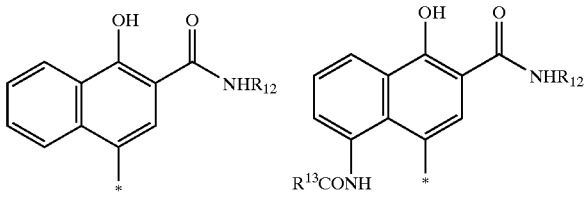

* denotes link to —$(L)_n$—ETA or —(SAM)—$NX^1$—$NX^2X^3$ where $R^{12}$ and $R^{13}$ are individually a ballast group, a hydrogen, a substituted or unsubstituted alkyl or aryl group or a substituted or unsubstituted alkyloxy or aryloxy group, $R^{11}$ is a halogen atom, an alkyl group having from 1 to 4 carbon atoms or an alkoxy group having from 1 to 4 carbon atoms, and w is 1 or 2. Generally $R^{12}$ and $R^{13}$ are groups having less than 20 carbon atoms.

Couplers that form magenta dyes upon reaction with oxidized developing agent are described in such representative patents and publications as U.S. Pat. Nos. 2,600,788; 2,369,489; 2,343,703; 2,311,082; 3,824,250; 3,615,502; 4,076,533; 3,152,896; 3,519,429; 3,062,653; 2,908,573; 4,540,654; and "Farbkuppler: Eine Literaturubersicht," published in Agfa Mitteilungen, Band III, pp. 126–156 (1961).

Preferably, such couplers are pyrazolones and pyrazolotriazoles that form magenta dyes upon reaction with oxidized developing agents at the coupling position, i.e., the carbon atom in the 4-position for pyrazolones and the 7-position for pyrazolotriazoles. Structures of such preferred magenta coupler moieties are:

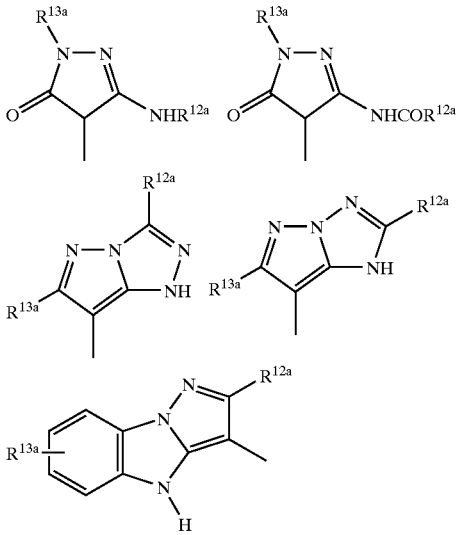

wherein $R^{12a}$ and $R^{13a}$ are as defined above for $R^{12}$ and $R^{13}$. $R^{13a}$ for pyrazolone structures is typically a phenyl group or a substituted or unsubstituted phenyl group, such as, for example, 2,4,6-trihalophenyl. For the pyrazolotriazole structures $R^{13a}$ is typically alkyl or aryl.

Couplers that form yellow dyes on reaction with oxidized color developing agent are described in such representative patents and publications as U.S. Pat. Nos. 2,875,057; 2,407,210; 3,265,506; 2,298,443; 3,048,194; and 3,447,928; and "Farbkuppler: Eine Literaturubersicht," published in Agfa Mitteilungen, Band III, pp. 112–126 (1961).

Preferably, such yellow dye-forming couplers are acylacetamides, such as benzoylacetanilides and pivalylacetanilides. These couplers react with oxidized developing agent at the coupling position, i.e., the active methylene carbon atom. Structures of such preferred yellow couplers are:

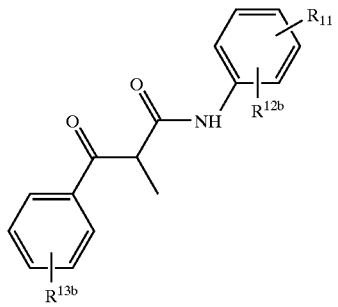

where $R^{12b}$ and $R^{13b}$ are as defined above for $R^{12}$ and $R^{13}$ and can also be alkoxy, alkoxycarbonyl, alkanesulfonyl, arenesulfonyl, aryloxycarbonyl, carbonamido, carbamoyl, sulfonamido, or sulfamoyl. $R^{11b}$ is hydrogen or one or more halogen, lower alkyl, (i.e., methyl, ethyl), lower alkoxy (i.e., methoxy, ethoxy), or a ballast (i.e., alkoxy of 16 to 20 carbon atoms) group.

Couplers that form colorless products upon reaction with oxidized color developing agent are described in such representative patents as U.K. Patent No. 861, 138 and U.S. Pat. Nos. 3,632,345; 3,928,041; 3,958,993; and 3,961,959. Preferably, such couplers are cyclic carbonyl containing compounds that form colorless products on reaction with oxidized color developing agent and have the L or —(SAM)-$NX^1$—NX2X3 group attached to the carbon atom in the α-position with respect to the carbonyl group. Structures of such preferred couplers are:

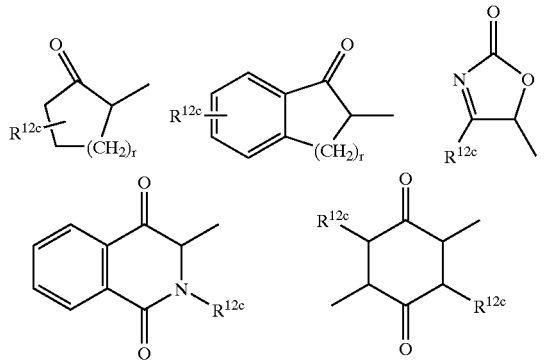

where $R^{12c}$ is defined as above for $R^{12}$, and r is 1 or 2.

It will be appreciated, depending on the particular coupler moiety, or the particular developing agent, or the type of processing, the reaction product of the coupler and oxidized color developing agent can be: (1) colored and non-diffusible, in which case it may not be removed during processing from the location where it is formed; (2) colored and diffusible, in which case it may be removed during processing from the location where it is formed or allowed to migrate to a different location; or (3) colorless and diffusible or non-diffusible, in which case it will not contribute to image density.

Especially preferred structures for CAR-$(L)_n$-ETA are compounds E-1 through E-19.

E-1

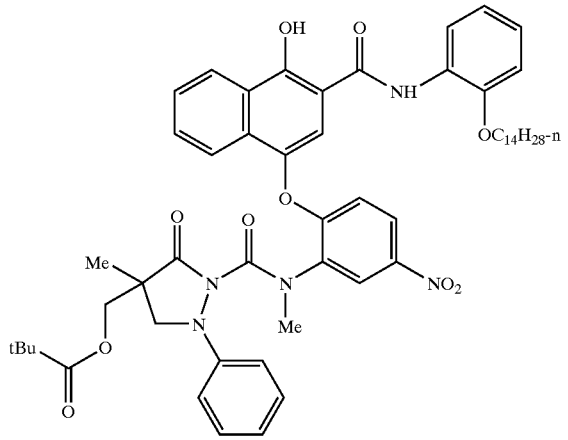

E-2

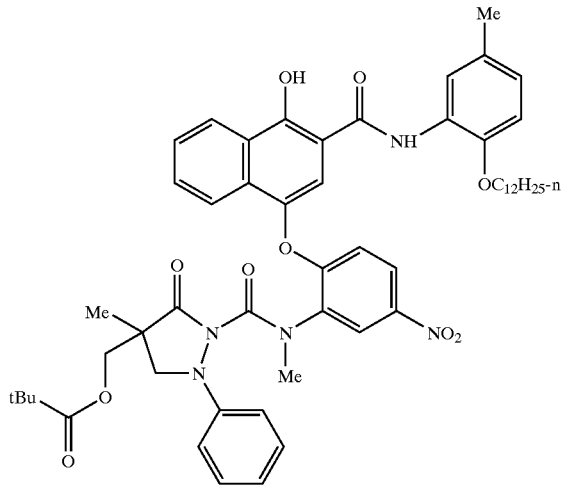

E-3

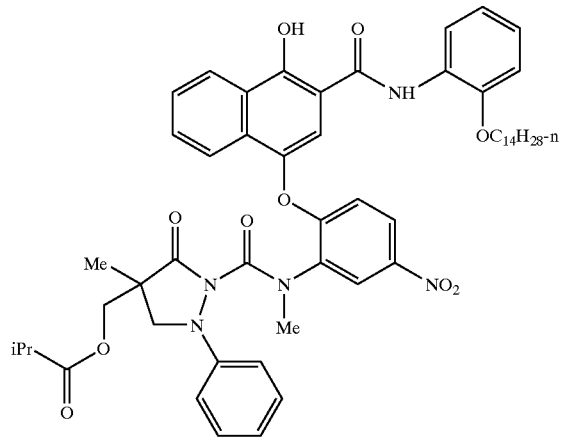

-continued
E-4
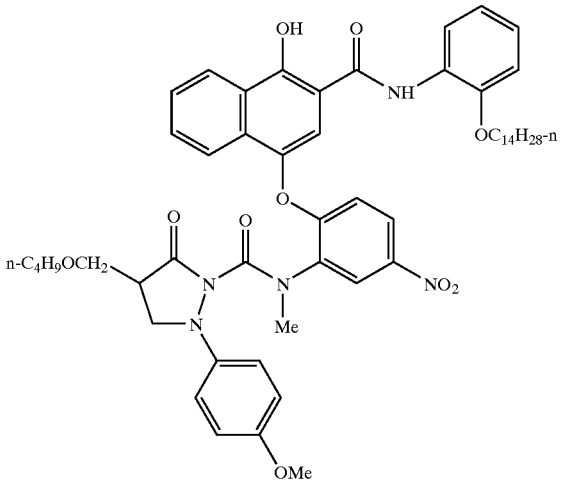
E-5
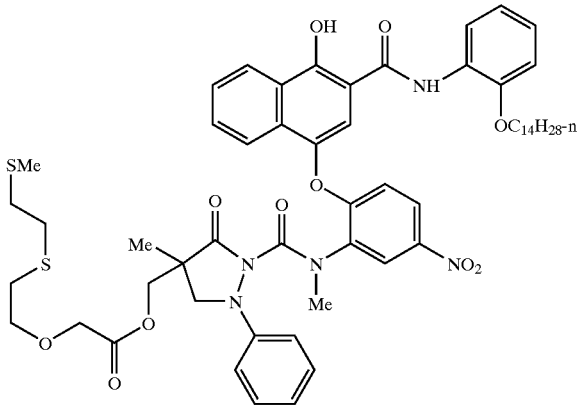
E-6
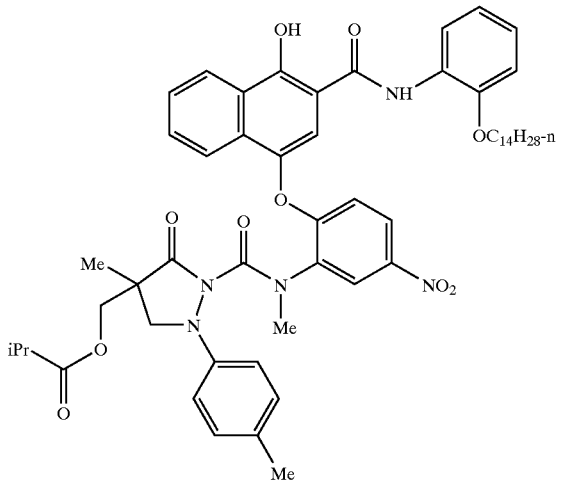
-continued
E-7
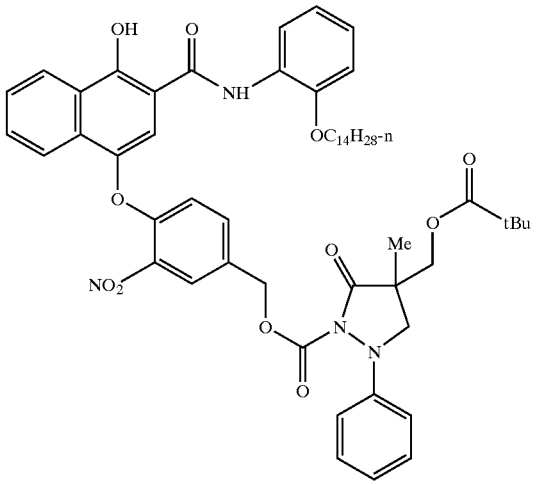
E-8
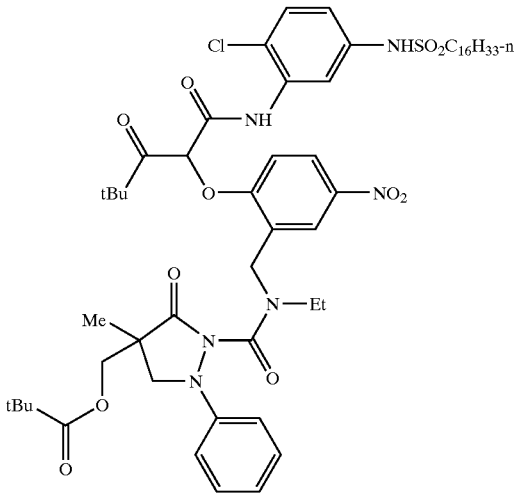
E-9
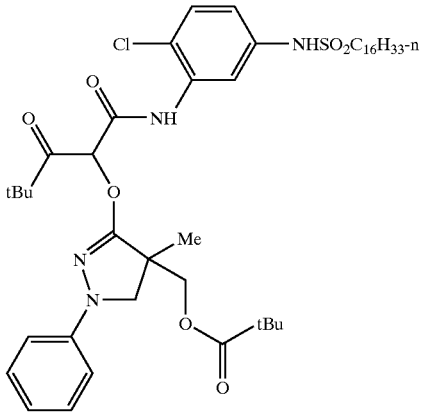

-continued
E-10
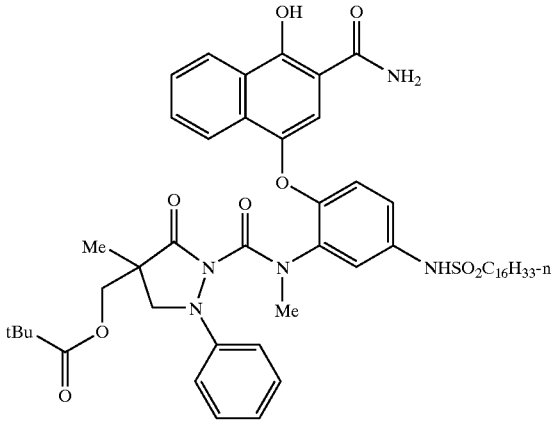
E-11
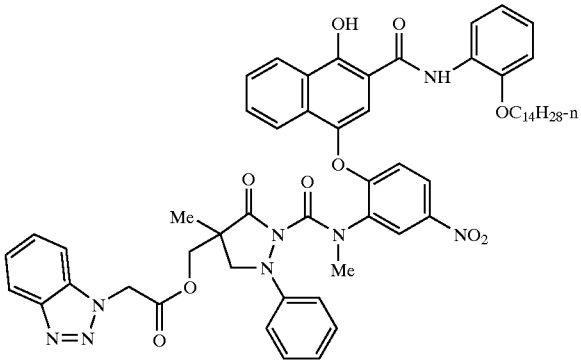
E-12
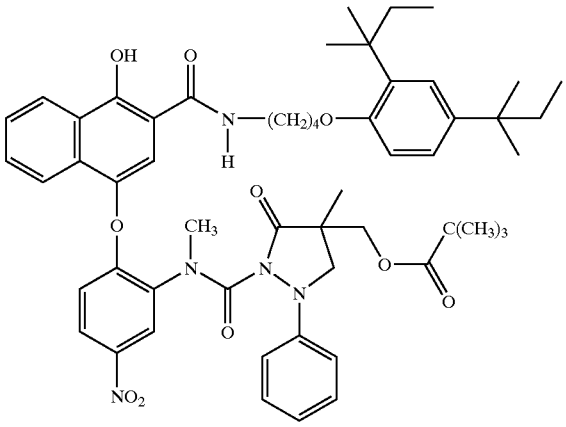
-continued
E-13
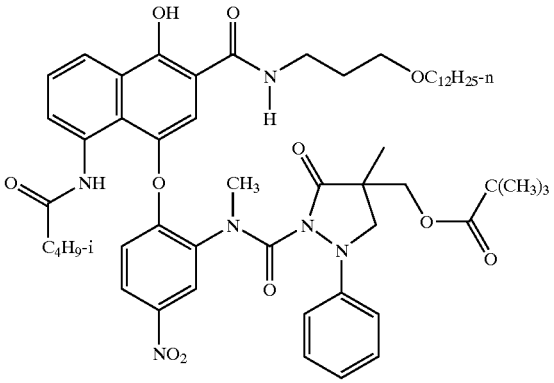
E-14
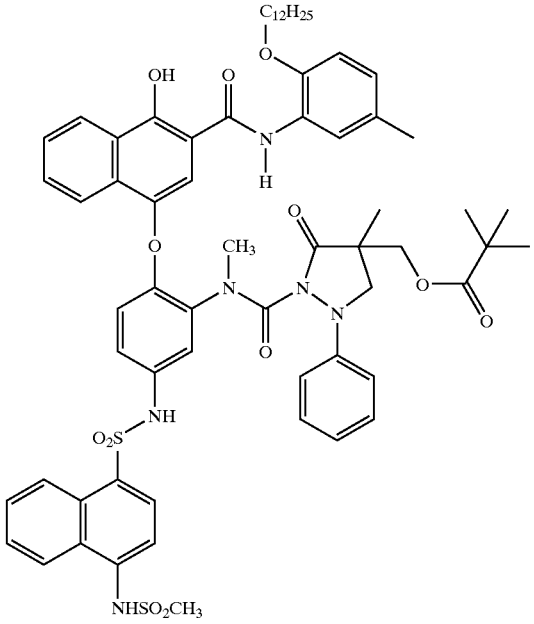
E-15
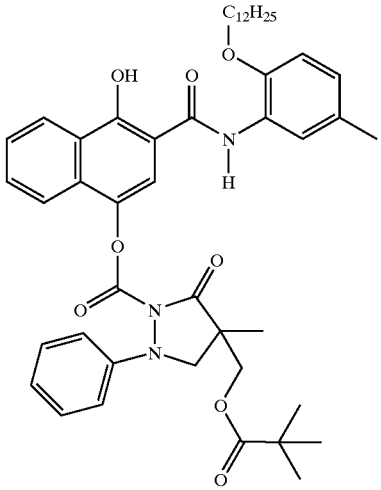

-continued

E-16

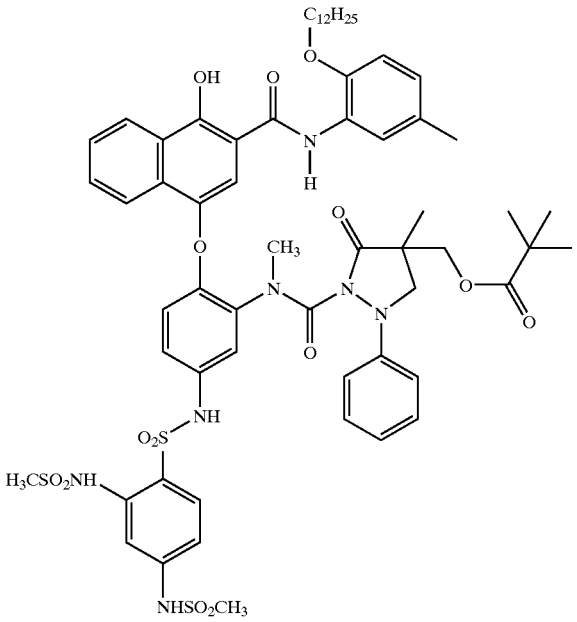

E-17

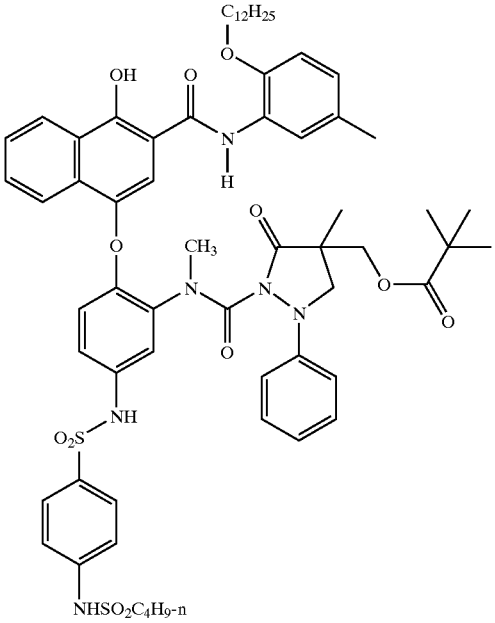

-continued

E-18

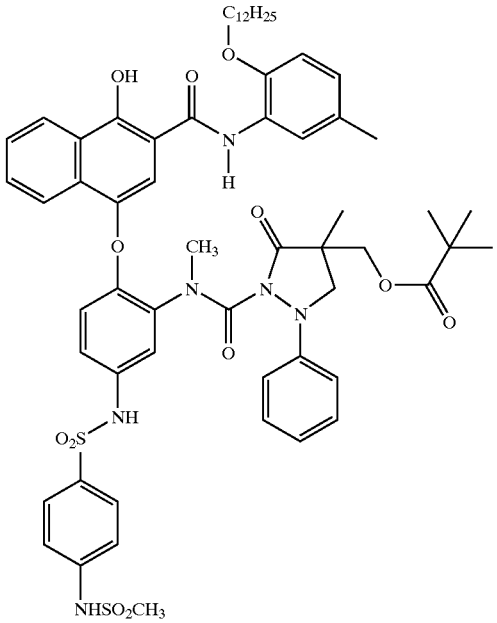

E-19

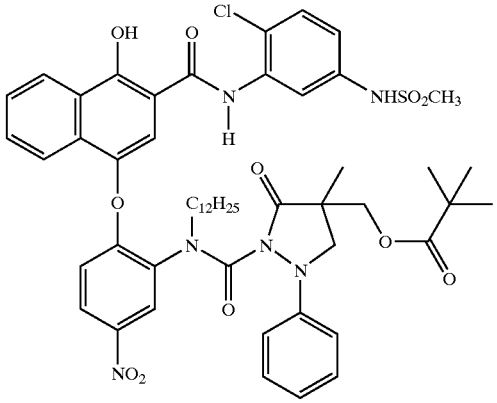

Preferably the silver halide imaging layer containing the ETARC and the fogged grains also contains the development accelerator releasing compound (DARC) represented by formula (II).

$$CAR^2—(SAM)-NX^1—NX^2X^3 \quad (II)$$

$CAR^2$ is a carrier moiety which is capable of releasing —(SAM)-$NX^1$—$NX^2X^3$ on reaction with oxidized developing agent. $CAR^2$ has been defined in detail above. SAM is a silver absorbable moiety attached directly to the carrier moiety and is released on reaction with oxidized development agent. A silver absorbable moiety is an atom or group of atoms that is strongly absorbed on silver surfaces. Suitable atoms that are strongly absorbed to silver are sulfur, selenium, and nitrogen. A preferred atom is sulfur. Suitable groups that are strongly absorbed to silver are nitrogen containing heterocycles with at least one N—H in its released form according to formula SAM-1 or heterocycles with a free —SH (or its tautomeric equivalent) in its released form according to formula SAM-2:

SAM-1

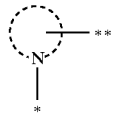

SAM-2

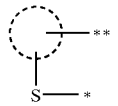

where the dashed line represents the atoms necessary to form a heterocyclic ring, * denotes the site of attachment to $CAR^2$ and ** denotes the site of attachment to the hydrazine group. The heterocycles are typically inhibitors of silver development and may be selected from any of the known classes of silver development inhibitors. Among the preferred classes of groups that are strongly absorbed to silver and known to act as inhibitors of silver development are mercaptotetrazoles, mercaptotriazoles, mercaptothiadiazoles, mercaptooxadiazoles, mercaptotetraazaindenes, mercaptobenzoxazines, benzotriazoles, triazoles, tetrazoles, and tetrazaindenes.

It should be appreciated that there may be additional atoms present that chemically link the hydrazine group to the SAM and that the hydrazine group need not be connected directly to the SAM. It is preferred that the spacer atoms be an alkyl, ether, thioether or aryl group with 12 carbon atoms or less, or more preferably, 6 carbon atoms or less. An aryl group is particularly preferred. It should also be appreciated that there may be an optional timing or switch group located between $CAR^2$ and SAM such that when $CAR^2$ reacts with oxidized developer, the timing or switch group is released from $CAR^2$ which then subsequently decomposes and releases the —(SAM)-$NX^1$—$NX^2X^3$ group. Any of the appropriate well-known timing or switch groups are appropriate for this use, although it is preferred that a timing or switch group is not present.

Some examples of the SAM fragment including, when appropriate, any additional atoms that connect the SAM to the hydrazine are:

CAR—S—$CH_2CH_2CONH$—$C_6H_4$-p-(Hydrazine)
CAR—S—$CH_2CH_2OC_6H_4$-m-(Hydrazine)
CAR—S—$C_6H_4$-m-(Hydrazine)

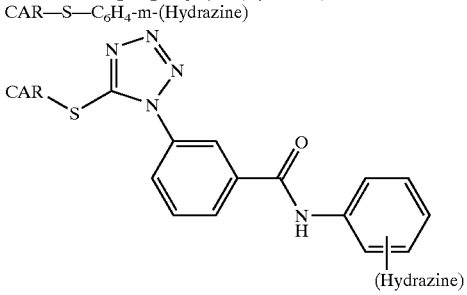

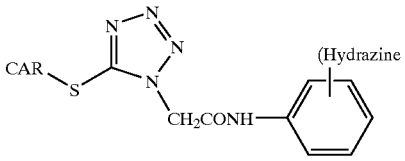

-continued

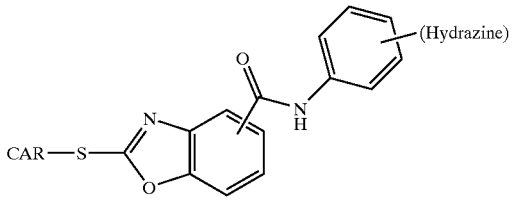

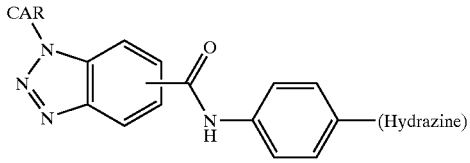

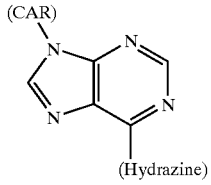

$X^1$, $X^2$ and $X^3$ are individually hydrogen or a substituent chosen from alkyl, aryl, carbonyl or sulfonyl groups with the proviso that at least one of $X^1$, $X^2$ and $X^3$ is hydrogen. In particular, it is preferred that $X^1$ and $X^2$ are individually hydrogen or an acyl or alkoxycarbonyl group containing 1 to 16 carbon atoms, and more preferably, 1 to 6 carbon atoms. It is most preferred that $X^1$ and $X^2$ are both hydrogen. It is preferred that $X^3$ is an acyl group (—C(=O)—), a thioacyl group (—C(=S)—), a carbamoyl group (—C(=O)N<), an alkyloxycarbonyl group (—C(=O)O-alkyl), an aryloxycarbonyl group (—C(=O)O-aryl), an oxalate (—C(=O)—C(=O)—) or oxalate ester (—C(=O)—C(=O)O—) group, an oxalamido group (—C(=O)—C(=O)N<), a sulfonyl group or a sulfamoyl group, each of which may contain 1 to 16 carbon atoms, or more preferably, 1 to 7 carbon atoms. It is most preferred that $X^3$ is a formyl group, an acetyl group, a trifluoroacetyl group, an oxalate or oxalate ester group, a methanesulfonyl group, or an arylsulfonyl group.

Some examples of the hydrazine moiety are:

—NH—NH—CHO
—NH—NH—CO—$CH_3$
—NH—NH—CO—$CF_3$
—NH—NH—$SO_2CH_3$
—NH—NH—S $O_2$—$C_6H_4$—m—$CH_3$
—N(CHO)—NH—CHO
—NH—NH—$CO_2C_2H_5$
—NH—NH—CO—$NH_2$
—NH—NH—CO—CO—$CH_3$
—NH—NH—CO—CO—$OCH_3$
—NH—NH—CO—CO—$NHC_2H_5$

Some specific examples of the DARCs which may be utilized in the invention are:

D-1
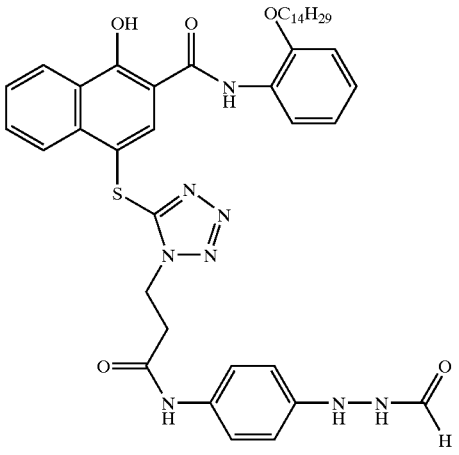
D-2
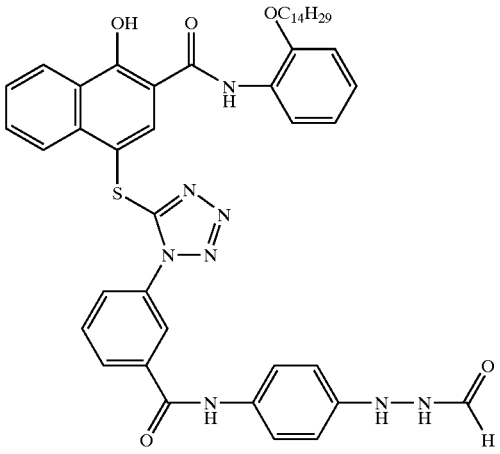
D-3
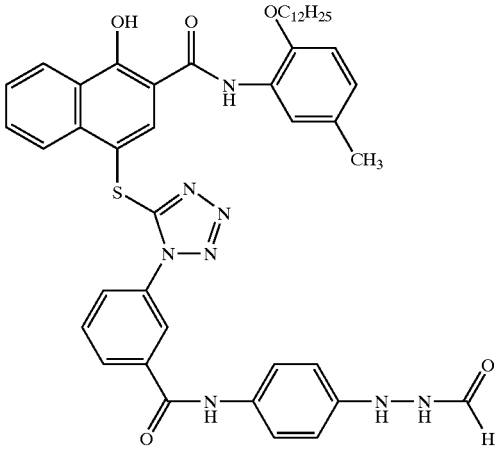

-continued
D-4
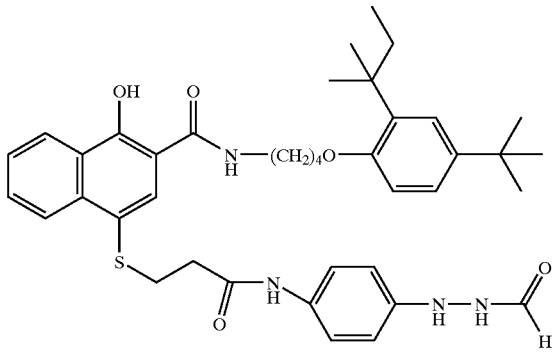
D-5
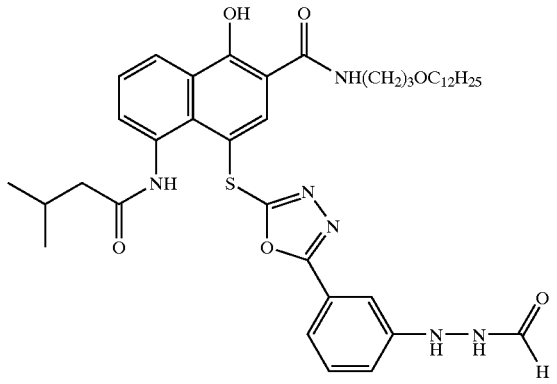
D-6
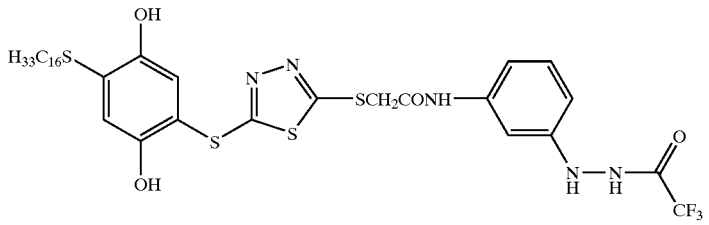
D-7
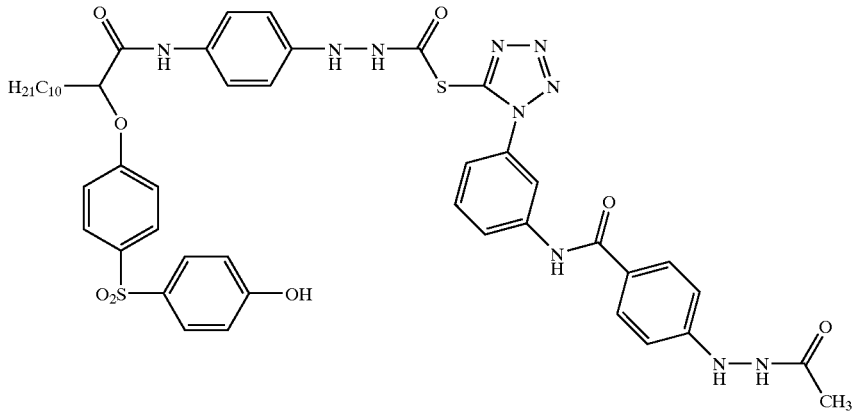

-continued
D-8
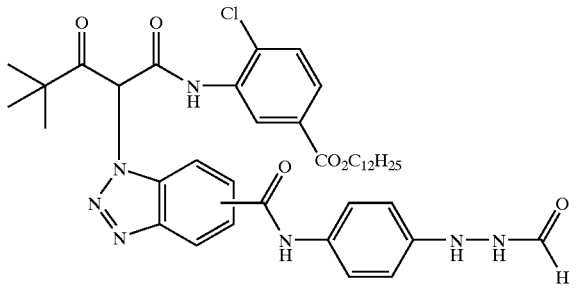
D-9
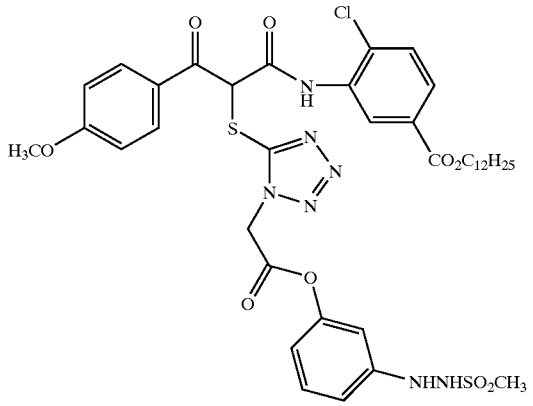
D-10
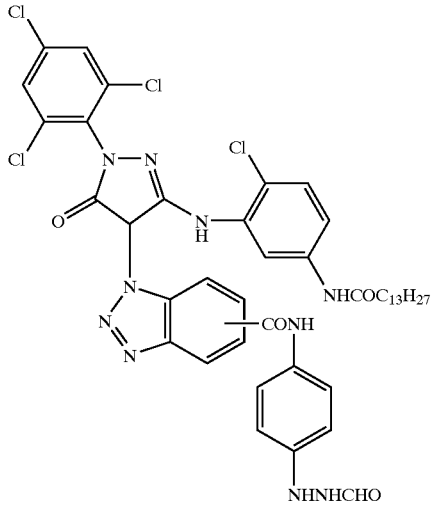
D-11
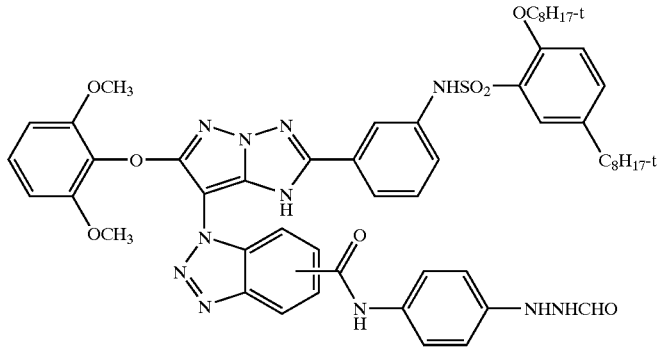

-continued

D-12

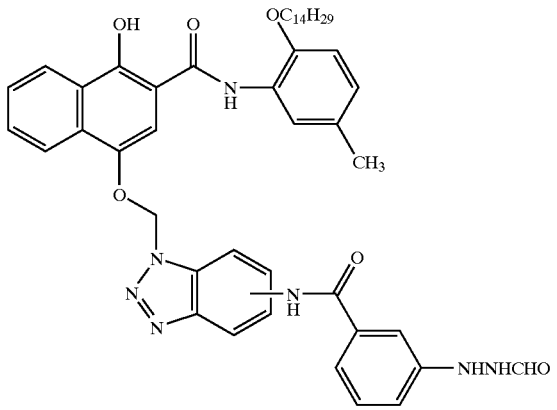

D-13

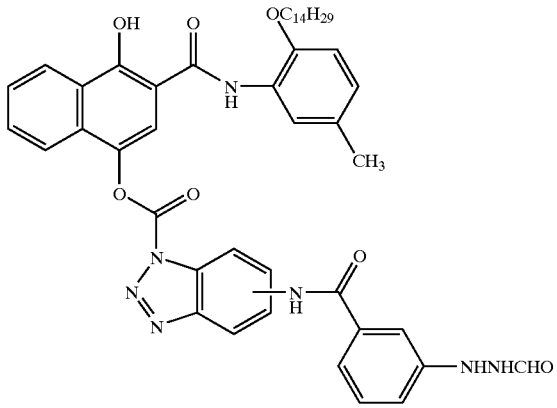

D14

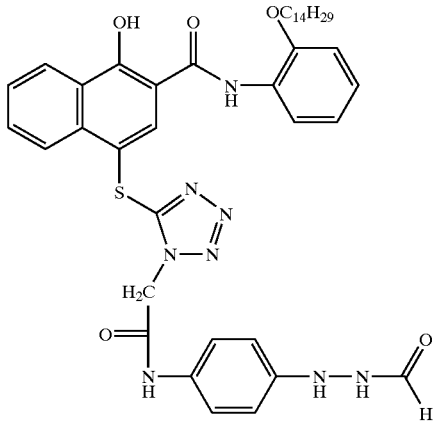

It is desired that the hydrazine of the —(SAM)-$NX^1$—$NX^2X^3$ group is inactive until released. Attachment to a ballasted, non-water soluble CAR moiety inactivates the hydrazine so that it is unlikely to cause undesirable reactions during storage of the photographic material. However, the oxidized developer formed in an imagewise manner as a consequence of silver halide development reacts with the $CAR^2$ moiety to lead to the cleavage of the bond between the $CAR^2$ and —(SAM)-$NX^1$—-$NX^2X^3$. For good storage properties, the DARC compound should be dispersed either as a finely-divided solid particle dispersion or in a high boiling organic solvent as discussed below.

The electron transfer agent releasing coupler compounds of this invention can be prepared according to the methods described in U.S. Pat. Nos. 6,110,657 and 5,605,786. The development accelerator releasing coupler compounds of this invention can be generally prepared according to the methods described in U.S. Pat. Nos. 4,482,629; 4,820,616; and 4,618,572.

A dispersion of ETARC or DARC incorporates the material in a stable, finely divided state in a hydrophobic organic solvent (often referred to as a coupler solvent or permanent solvent) that is stabilized by suitable surfactants and surface active agents usually in combination with a binder or matrix such as gelatin. The dispersion may contain one or more permanent solvents that dissolve the material and maintain it in a liquid state. Some examples of suitable permanent solvents are tricresylphosphate, N,N-diethyllauramide, N,N-dibutyllauramide, p-dodecylphenol, dibutylphthalate, di-n-butyl sebacate, N-n-butylacetanilide, 9-octadecen-1-ol, ortho-methylphenyl benzoate, trioctylamine and 2-ethylhexylphosphate. Preferred classes of solvents are carbonamides, phosphates, phenols, alcohols, and esters. When a solvent is present, it is preferred that the weight ratio of compound to solvent be at least 1 to 0.5, or most preferably, at least 1 to 1. Preferred solvents are tricresyl phosphate, N,N-diethyl or N,N-di-n-butyllauramide, di-n-butyl sebacate, p-dodecylphenol, and 2,5-di-t-amylphenol. It is particularly desirable to disperse the ETARC or DARC in the same solvent that is present with the image coupler that is present in the same layer. The dispersion may require an auxiliary coupler solvent initially to dissolve the component, but this is removed afterwards, usually either by evaporation or by washing with additional water. Some examples of suitable auxiliary coupler solvents are ethyl acetate, cyclohexanone, and 2-(2-butoxyethoxy)ethyl acetate. The dispersion may also be stabilized by the addition of polymeric materials to form stable latexes. Examples of suitable polymers for this use generally contain water-solubilizing groups or have regions of high hydrophilicity. Some examples of suitable dispersing agents or surfactants are Alkanol XC or saponin. The materials of the invention may also be dispersed as an admixture with another component of the system such as a coupler or an oxidized developer scavenger so that both are present in the same oil droplet. It is also possible to incorporate the materials of the invention as a solid particle dispersion; that is, a slurry or suspension of finely ground (through mechanical means) compound. These solid particle dispersions may be additionally stabilized with surfactants and/or polymeric materials as known in the art. Also, additional permanent solvent may be added to the solid particle dispersion to help increase activity.

The combination of the fine fogged grains with ETARCs and, optionally, DARCs offers enhanced photographic speed. The type of light sensitive imaging silver halide emulsion used in the imaging layer may be important to obtain the desired increase in light sensitivity. The silver halide emulsion is suitably a silver iodobromide emulsion, meaning an emulsion that is low in chloride. By low in chloride, it is meant that there should be no more than 20 mol % chloride. More suitably, there is present in the layer no more than 10 mol % chloride, and typically no more than 1 mol % chloride. The emulsion suitably contains at least 0.01 mol % iodide, or more preferably, at least 0.5 mol % iodide, or most preferably, at least 1 mol % iodide. The benefit of the increase in light sensitivity is most apparent in combination with larger sized emulsions that are associated with increased granularity. Thus, it is preferred that the compounds of the invention are used with emulsions that have an equivalent circular diameter of at least 0.6 micrometer, or more preferably, at least 0.8 micrometer, or most preferably, at least 1.0 micrometer. In addition, the benefit of the invention is greatest in origination materials such as color negative materials since they require higher sensitivity to light (because of the variable lighting conditions in natural scenes) and low granularity (due to high magnification) relative to color print materials for which exposure conditions are carefully controlled and which are viewed directly under low magnification conditions.

In order to control and maintain granularity over a wide exposure range, it is a common practice to divide an individual color record (also known as a dye forming unit) into separate layers, each containing silver halide emulsions of different degree of sensitivity to the same color of light. While the combination of the invention is most preferred and useful in the most light sensitive layer, it is possible to use the combination in more than one record that is sensitive to the same color of light. For example, in a color record that is split into three layers of different relative sensitivity; fast (F), mid (M) or slow (S), the ETARC and DARC compounds can be used in each layer, only one layer, or in any combination; i.e., F+M, F+M+S, F+S, etc.; providing they are in the same imaging layer as the fine fogged grains. It is not necessary that these layers are adjacent; that is, they may have interlayers or even imaging layers that are sensitive to other colors located between them. In addition, although the most light sensitive layer is typically located in the film structure closest to the exposure source and farthest from the support, the combination of the invention allow for alternative locations of the layers; for example, a more light sensitive layer containing the compounds of the invention may be located below (farther from the exposing source) than a less sensitive layer. It is also possible to use the compounds of the invention in more than one color record at a time.

Moreover, when a number of layers of the same spectral sensitivity but of differing degrees of sensitivity to light are used, it is known that overall granularity can be minimized by using a smaller molar amount of dye-forming coupler than silver in the layers of higher sensitivity. Thus, it is preferred that the light sensitive layer containing the compounds of the invention additionally contain less than a stoichiometric amount of total dye forming coupler(s) relative to the amount of silver contained in the same layer. A suitable molar ratio of dye-forming coupler(s) to silver in the layer containing the compound of the invention would be less than 0.5. Most preferred would be a ratio of 0.2 or even 0.1 or less. In the most extreme case, the ETARC and DARC could be the only coupling species present in the imaging layer.

Unless otherwise specifically stated, substituent groups which may be substituted on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy)propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy) ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3- to 7-membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

The photographic elements of the invention are negative working photographic elements, preferably color. The photographic elements of the invention can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. The fine fogged grains, the ETARC, and the DARC compounds are contained in the same silver halide emulsion layer, preferably in the red-sensitive layer, and most preferably, in the most red light sensitive layer.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire PO10 7DQ, ENGLAND, the contents of which are incorporated herein by reference. Further, the photographic elements may have an annealed polyethylene naphthalate film base such as described in Hatsumei Kyoukai Koukai Gihou No. 94-6023, published Mar. 15, 1994 (Patent Office of Japan and Library of Congress of Japan) and may be utilized in a small format system, such as described in *Research Disclosure*, June 1994, Item 36230 published by Kenneth Mason Publications, Ltd., Dudley Annex, 12a North Street, Emsworth, Hampshire PO10 7DQ, ENGLAND, and such as the Advanced Photo System, particularly the Kodak ADVANTIX films or cameras.

In the following Table, reference will be made to (1) *Research Disclosure*, December 1978, Item 17643, (2) *Research Disclosure*, December 1989, Item 308119, (3) *Research Disclosure*, September 1994, Item 36544, and (4) *Research Disclosure*, September 1996, Item 38957, all published by Kenneth Mason Publications, Ltd., Dudley Annex, 12a North Street, Emsworth, Hampshire PO10 7DQ, ENGLAND, the disclosures of which are incorporated herein by reference. The Table and the references cited in the Table are to be read as describing particular components suitable for use in the elements of the invention. The Table and its cited references also describe suitable ways of preparing, exposing, processing and manipulating the elements, and the images contained therein. Photographic elements and methods of processing such elements particularly suitable for use with this invention are described in *Research Disclosure*, February 1995, Item 37038, published by Kenneth Mason Publications, Ltd., Dudley Annex, 12a North Street, Emsworth, Hampshire PO10 7DQ, ENGLAND, the disclosure of which is incorporated herein by reference.

| Reference | Section | Subject Matter |
|---|---|---|
| 1 | I, II | Grain composition, |
| 2 | I, II, IX, X, XI, XII, XIV, XV | morphology and preparation. Emulsion preparation |
| 3 & 4 | I, II, III, IX A & B | including hardeners, coating aids, addenda, etc. |
| 1 | III, IV | Chemical sensitization and |
| 2 | III, IV | spectral sensitization/ |
| 3 & 4 | IV, V | Desensitization |
| 1 | V | UV dyes, optical brighteners, |
| 2 | V | luminescent dyes |
| 3 & 4 | VI | |
| 1 | VI | Antifoggants and stabilizers |
| 2 | VI | |
| 3 & 4 | VII | |
| 1 | VIII | Absorbing and scattering |
| 2 | VIII, XIII, XVI | materials; Antistatic layers; |
| 3 & 4 | VIII, IX C & D | matting agents |
| 1 | VII | Image-couplers and image- |
| 2 | VII | modifying couplers; Washout |
| 3 & 4 | X | couplers; Dye stabilizers and hue modifiers |
| 1 | XVII | Supports |
| 2 | XVII | |
| 3 & 4 | XV | |
| 3 & 4 | XI | Specific layer arrangements |
| 3 & 4 | XII, XIII | Negative working emulsions; Direct positive emulsions |
| 2 | XVIII | Exposure |
| 3 & 4 | XVI | |
| 1 | XIX, XX | Chemical processing; |
| 2 | XIX, XX, XXII | Developing agents |
| 3 & 4 | XVIII, XIX, XX | |
| 3 & 4 | XIV | Scanning and digital processing procedures |

The photographic elements can be incorporated into exposure structures intended for repeated use or exposure structures intended for limited use, variously referred to as single use cameras, lens with film, or photosensitive material package units.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, heteroxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169; 3,227,551; 3,432,521; 3,476,563; 3,617,291; 3,880,661; 4,052,212 and 4,134,766; and in UK. Patents and published application Nos. 1,466,728; 1,531,927; 1,533,039; 2,006,755A and 2,017,704A, the disclosures of which are incorporated herein by reference.

Other image dye-forming couplers may be included in the element such as those image couplers already described above for CAR. In one preferred embodiment a dye forming coupler is contained in the same emulsion layer as the ETARC utilized in this invention. Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628; 5,151,343; and 5,234,800.

It may be useful to use a combination of couplers any of which may contain known ballasts or coupling-off groups such as those described in U.S. Pat. Nos. 4,301,235; 4,853,319; and 4,351,897. The coupler may contain solubilizing groups such as described in U.S. Pat. No. 4,482,629. The coupler may also be used in association with "wrong" colored couplers (e.g., to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; UK. Patent 1,530,272; and Japanese Application 58-113935. The masking couplers may be shifted or blocked, if desired. Normally masking couplers are not used in reversal type elements.

The invention materials may be used in association with materials that accelerate or otherwise modify the processing steps, e.g., of bleaching or fixing to improve the quality of the image. Bleach accelerator releasing couplers such as those described in EP 193,389; EP 301,477; U.S. Pat. Nos. 4,163,669; 4,865,956; and 4,923,784, may be useful. Also contemplated is use of the compositions in association with nucleating agents, development accelerators or their precursors (UK Patents 2,097,140 and 2,131,188); electron transfer agents (U.S. Pat. Nos. 4,859,578 and 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g., as described in U.S. Pat. Nos. 4,366,237; 4,420,556; and 4,543,323 and EP 96,570). Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIR's). Such image modifying compounds are particularly useful in negative working emulsions. DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,

346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

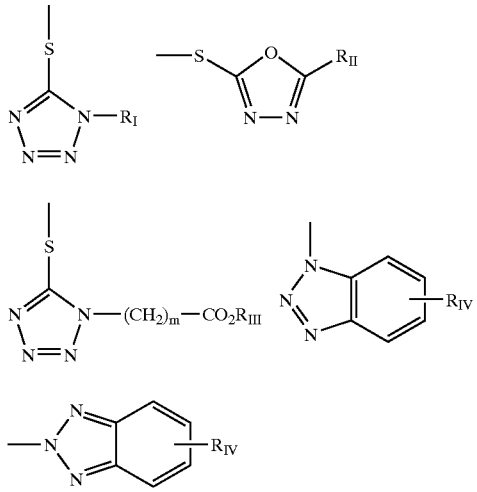

wherein $R_I$ is selected from the group consisting of straight and branched alkyls of from 1 to about 8 carbon atoms, benzyl, phenyl, and alkoxy groups and such groups containing none, one or more than one such substituent; $R^{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group, which produces the time-delayed release of the inhibitor group such as groups utilizing the cleavage reaction of a hemiacetal (U.S. Pat. No. 4,146,396 and Japanese Applications 60-249148; 60-249149); groups using an intramolecular nucleophilic substitution reaction (U.S. Pat. No. 4,248,962); groups utilizing an electron transfer reaction along a conjugated system (U.S. Pat. Nos. 4,409,323 and 4,421,845 and Japanese Applications 57-188035; 58-98728; 58-209736; 58-209738) groups utilizing ester hydrolysis (German Patent Application (OLS) No. 2,626,315); groups utilizing the cleavage of imino ketals (U.S. Pat. No. 4,546,073); groups that function as a coupler or reducing agent after the coupler reaction (U.S. Pat. Nos. 4,438,193 and 4,618,571) and groups that combine the features described above. It is typical that the timing group or moiety is of one of the formulas:

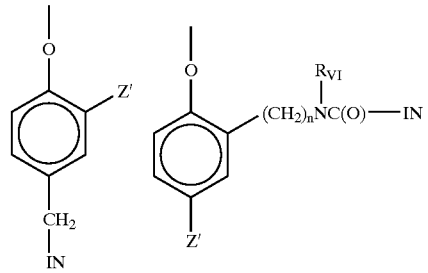

wherein IN is the inhibitor moiety, Z' is selected from the group consisting of nitro, cyano, alkylsulfonyl; sulfanoyl (—$SO_2NR_2$); and sulfonamido (—$NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

Suitable developer inhibitor-releasing couplers for use in the present invention include, but are not limited to, the following:

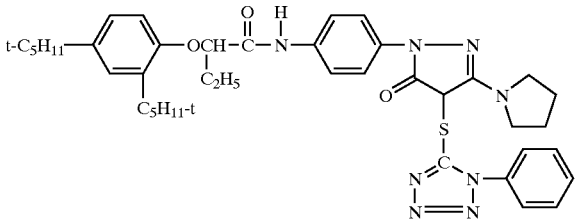

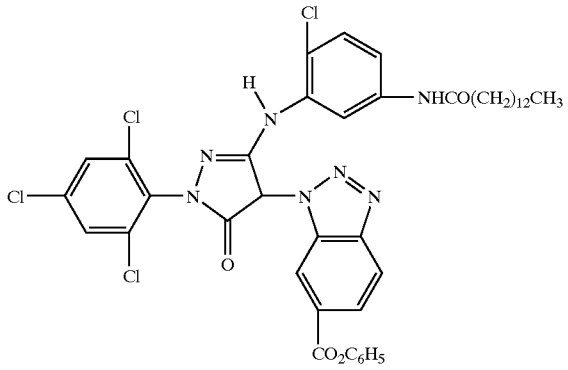

-continued
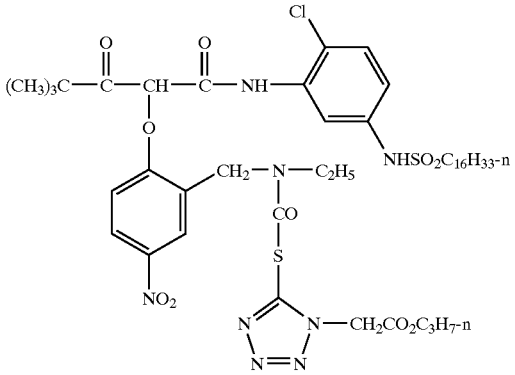
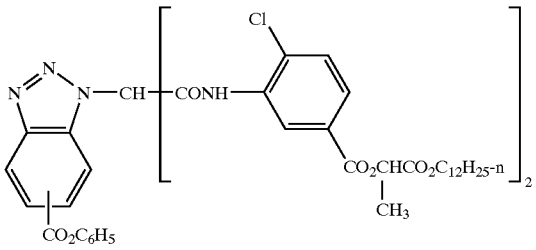
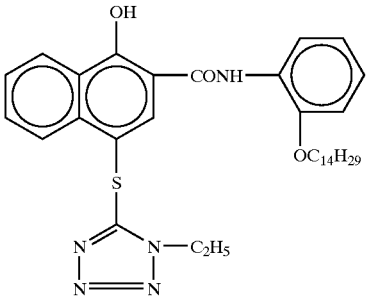
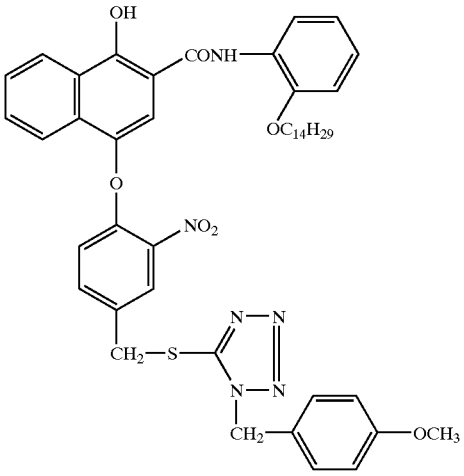
-continued
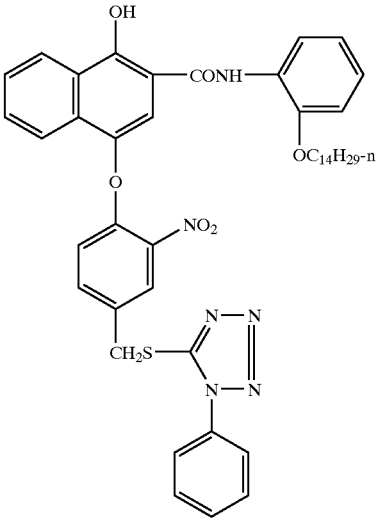
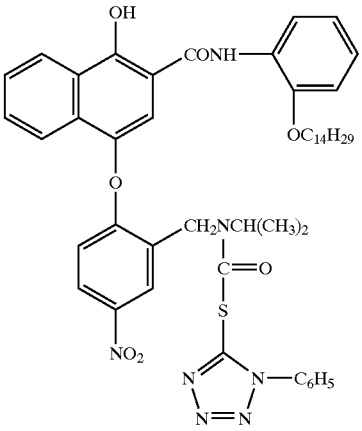
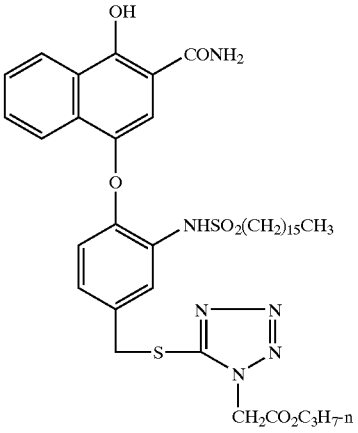

-continued

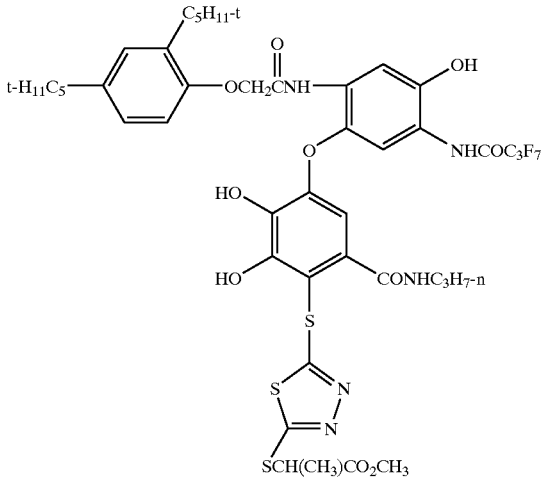

It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire PO10 7DQ, England, incorporated herein by reference. Materials of the invention may be coated on pH adjusted support as described in U.S. Pat. No. 4,917,994; on a support with reduced oxygen permeability (EP 553,339); with epoxy solvents (EP 164,961); with nickel complex stabilizers (U.S. Pat. Nos. 4,346,165; 4,540,653 and 4,906,559, for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629; 90-072,630; 90-072,631; 90-072,632; 90-072,633; 90-072,634; 90-077,822; 90-078,229; 90-078,230; 90-079,336; 90-079,337; 90-079,338; 90-079,690; 90-079,691; 90-080,487; 90-080,488; 90-080,489; 90-080,490; 90-080,491; 90-080,492; 90-080,494; 90-085,928; 90-086,669; 90-086,670; 90-087,360; 90-087,361; 90-087,362; 90-087,363; 90-087,364; 90-088,097; 90-093,662; 90-093,663; 90-093,664; 90-093,665; 90-093,666; 90-093,668; 90-094,055; 90-094,056; 90-103,409; 83-62,586; and 83-09,959.

The silver halide imaging emulsions utilized may be of any silver halide composition, including but not limited to silver bromide, silver bromoiodide, silver chlorobromide, and silver chloroiodide. Preferably the silver halide imaging emulsions utilized in this invention are bromoiodide emulsions.

The silver halide emulsions can contain grains of any size and morphology. Thus, the grains may take the form of cubes, octahedrons, cubo-octahedrons, or any of the other naturally occurring morphologies of cubic lattice type silver halide grains. Further, the grains may be irregular such as spherical grains or tabular grains.

Especially useful in this invention are tabular grain silver halide imaging emulsions. Specifically contemplated tabular grain emulsions are those in which greater than 50 percent of the total projected area of the emulsion grains are accounted for by tabular grains having a thickness of less than 0.3 micrometer (0.5 micrometer for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECD's seldom exceed about 4 micrometers. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin ($t<0.2$ micrometer) tabular grains. To achieve the lowest levels of granularity it is preferred that aim tabular grain projected areas be satisfied with ultrathin ($t<0.06$ micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micrometer. Ultrathin tabular grain high chloride emulsions are disclosed by Maskasky U.S. Pat. No. 5,217,858.

As noted above tabular grains of less than the specified thickness account for at least 50 percent of the total grain projected area of the emulsion. To maximize the advantages of high tabularity, it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: *Research Disclosure*, Item 22534, January 1983, published by Kenneth Mason Publications, Ltd., Emsworth, Hampshire PO10 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The combination of fogged grains, ETARC and, optionally, DARC of the invention is particularly well suited for use with the 'low-developability' silver halide imaging emulsions as described in U.S. Pat. No. 5,998,121.

The imaging emulsions utilized in the invention, which are preferably iodobromide, may contain "low fogging" silver halide grains, preferably tabular silver halide grains. One definition of a "low fogging" emulsion is a fully surface spectrochemically sensitized emulsion with a low 'intrinsic fog level', defined as the fraction (Dmin-base density) divided by its net maximum density (Dmax-base density). Base density is determined by subjecting samples to a fixing step before the normal color development process. Maximum density is achieved when samples are given sufficient exposure above Dmin such that 0.6 log E less exposure produces less than 6% density reduction. This is measured in a format that is coupler rich, meaning it contains greater than or sufficient coupler on a molar basis that can fully react with the amount of silver halide moles coated per unit area. To demonstrate 'normal fog' vs. 'low fogging' emulsions, an emulsion containing layer may comprise (all values in $mg/m^2$) 430.4 mg Ag, 4304 mg gelatin, suitable surfactants, and 2 g tetraazaindene/mole of Ag, as well as a color forming coupler. As an example of a yellow record coupler, 1291 mg of Y-1 may be used in the emulsion layer; for a magenta record demonstration, 2077 mg of M-1 may be used and for a cyan record example, 602.6 mg of C-1 may be used. A nominal gel overcoat is typically used, for example, a 2690 mg gelatin overcoat hardened at 1.8% wt/wt hardener to total gelatin in the coating. A nominal time of development of 3' 15" in C-41 KODAK Color Negative Developer is used. A fully spectrochemically sensitized emulsion in this definition refers to one or more spectral sensitizing dyes being present that impart either cyan, magenta, or yellow spectral sensitization. Furthermore, the emulsion has been optimally chemically sensitized with a sulfiding agent such as sodium thiosulfate, a gold sensitizing agent such as potassium tetrachloroaurate, a reduction sensitizing agent such as stannous chloride or thiourea dioxide- or any two- or three-way combination of these three classes of chemical sensitizers.

It is known that the different couplers used in the different color records have influence on the extent of development of given silver halide emulsion experiences, such that different 'intrinsic fog levels' are defined for the different color records. For the blue sensitive or yellow record, an 'intrinsic fog level' fraction of 0.037 or less distinguishes 'low fogging' emulsions. For the green sensitive record, an 'intrinsic fog level' of 0.048 or less distinguishes 'low fogging' emulsions. For the red sensitive record, an 'intrinsic fog level' of 0.034 or less distinguishes 'low fogging' emulsions. It is expected that fully spectrochemically sensitized emulsions used in the most sensitive layers have been optimally sensitized both chemically and spectrally such that their response to light has been maximized at fog levels that are characterized as "normal" or else "low fogging". In addition, emulsions that have not been optimally sensitized to respond to light may meet the low intrinsic fog test, by virtue of being sensitized to achieve other properties such as maximum thermal stability upon extended keeping. These emulsions are also included in the above definition, although they are not normally considered to be fully spectrochemically sensitized.

If an emulsion meets the above definition of "low fogging", it is a "low fogging emulsion" regardless of the method of preparation of the emulsion. Another way to define "low fogging" is by the method of preparation of the emulsion. Emulsions prepared using the following described methods are considered to be "low fogging" whether they meet the above test or not: 1) tabular silver halide grains precipitated in a reaction vessel wherein the majority of the grain growth in the reaction vessel is performed at a pH of less than 4.0 (this includes starch precipitated emulsions as further described and traditional gelatin emulsions) and 2) tabular silver halide grains which have been precipitated in an aqueous medium containing a peptizer that is a water dispersible starch and which have been additionally precipitated in the presence of an oxidizing agent. Preferably the low pH method is utilized with starch precipitated emulsions. These methods will be described in detail below.

The silver halide imaging grains to be used in the invention may be prepared according to methods known in the art, such as those described in *Research Disclosure*, Item 38957 and James, *The Theory of the Photographic Process*. These methods generally involve mixing a water soluble silver salt with a water soluble halide salt in the presence of a protective colloid, and controlling the temperature, pAg, pH values, etc., at suitable values during formation of the silver halide by precipitation. In one embodiment of the invention the protective colloid or peptizer is a traditional gelatin peptizer.

In another embodiment of the invention the protective colloid or peptizer is water dispersible, cationic starch. The term "starch" is employed to include both natural starch and modified derivatives, such as dextrinated, hydrolyzed, alkylated, hydroxyalkylated, acetylated, or fractionated starch. The starch can be of any origin, such as cornstarch, wheat starch, potato starch, tapioca starch, sago starch, rice starch, waxy cornstarch, or high amylose cornstarch.

Starches are generally comprised of two structurally distinctive polysaccharides, α-amylose and amylopectin. Both are comprised of α-D-glucopyranose units. In α-amylose the α-D-glucopyranose units form a 1,4-straight chain polymer. The repeating units take the following form:

(I)

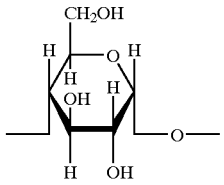

In amylopectin, in addition to the 1,4-bonding of repeating units, 6-position chain branching (at the site of the —$CH_2OH$ group above) is also in evidence, resulting in a branched chain polymer. The repeating units of starch and cellulose are diasteroisomers that impart different overall geometries to the molecules. The α anomer, found in starch and shown in formula I above, results in a polymer that is capable of crystallization and some degree of hydrogen bonding between repeating units in adjacent molecules, but not to the same degree as the β anomer repeating units of cellulose and cellulose derivatives. Polymer molecules formed by the β anomers show strong hydrogen bonding between adjacent molecules, resulting in clumps of polymer molecules and a much higher propensity for crystallization. Lacking the alignment of substituents that favors strong intermolecular bonding, found in cellulose repeating units, starch and starch derivatives are much more readily dispersed in water.

The water dispersible starches employed in the practice of the invention are cationic—that is, they contain an overall net positive charge when dispersed in water. Starches are conventionally rendered cationic by attaching a cationic substituent to the α-D-glucopyranose units, usually by esterification or etherification at one or more free hydroxyl sites. Reactive cationogenic reagents typically include a primary, secondary or tertiary amino group (which can be subsequently protonated to a cationic form under the intended conditions of use) or a quaternary ammonium, sulfonium or phosphonium group.

To be useful as a peptizer the cationic starch must be water dispersible. Many starches disperse in water upon heating to temperatures up to boiling for a short time (e.g., 5 to 30 minutes). High sheer mixing also facilitates starch dispersion. The presence of cationic substituents increases the polar character of the starch molecule and facilitates dispersion. The starch molecules preferably achieve at least a colloidal level of dispersion and ideally are dispersed at a molecular level—i.e., dissolved.

The following teachings illustrate water dispersible cationic starches within the contemplation of the invention:

*Rutenberg et al U.S. Pat. No. 2,989,520;
Meisel U.S. Pat. No. 3,017,294;
Elizer et al U.S. Pat. No. 3,051,700;
Aszolos U.S. Pat. No. 3,077,469;
Elizer et al U.S. Pat. No. 3,136,646;
*Barber et al U.S. Pat. No. 3,219,518;
*Mazzarella et al U.S. Pat. No. 3,320,080;
Black et al U.S. Pat. No. 3,320,118;
Caesar U.S. Pat. No. 3,243,426;
Kirby U.S. Pat. No. 3,336,292;
Jarowenko U.S. Pat. No. 3,354,034;
Caesar U.S. Pat. No. 3,422,087;
*Dishburger et al U.S. Pat. No. 3,467,608;
*Beaninga et al U.S. Pat. No. 3,467,647;
Brown et al U.S. Pat. No. 3,671,310;
Cescato U.S. Pat. No. 3,706,584;
Jarowenko et al U.S. Pat. No. 3,737,370;
*Jarowenko U.S. Pat. No. 3,770,472;
Moser et al U.S. Pat. No. 3,842,005;
Tessler U.S. Pat. No. 4,060,683;
Rankin et al U.S. Pat. No. 4,127,563;
Huchette et al U.S. Pat. No. 4,613,407;
Blixt et al U.S. Pat. No. 4,964,915;
*Tsai et al U.S. Pat. No. 5,227,481; and
*Tsai et al U.S. Pat. No. 5,349,089.

It is preferred to employ an oxidized cationic starch. The starch can be oxidized before (* patents above) or following the addition of cationic substituents. This is accomplished by treating the starch with a strong oxidizing agent. Both hypochlorite ($ClO^-$) or periodate ($IO_4^-$) have been extensively used and investigated in the preparation of commercial starch derivatives and preferred. While any convenient oxidizing agent counter ion can be employed, preferred counter ions are those fully compatible with silver halide emulsion preparation, such as alkali and alkaline earth cations, most commonly sodium, potassium, or calcium.

When the oxidizing agent opens the (α-D-glucopyranose ring, the oxidation sites are usually at the 2- and 3-position carbon atoms forming the α-D-glucopyranose ring. The 2- and 3-position

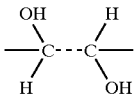

groups are commonly referred to as the glycol groups. The carbon-to-carbon bond between the glycol groups is replaced in the following manner:

(II)

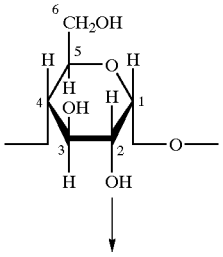

-continued

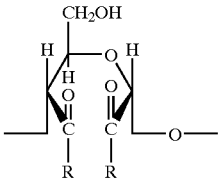

where R represents the atoms completing an aldehyde group or a carboxyl group.

The hypochlorite oxidation of starch is most extensively employed in commercial use. The hypochlorite is used in small quantities to modify impurities in starch. Any modification of the starch at these low levels is minimal, at most affecting only the polymer chain terminating aldehyde groups, rather than the α-D-glucopyranose repeating units themselves. At levels of oxidation that affect the α-D-glucopyranose repeating units the hypochlorite affects the 2-, 3-, and 6-positions, forming aldehyde groups at lower levels of oxidation and carboxyl groups at higher levels of oxidation. Oxidation is conducted at mildly acidic and alkaline pH (e.g., >5 to 11). The oxidation reaction is exothermic, requiring cooling of the reaction mixture. Temperatures of less than 45° C. are preferably maintained. Using a hypobromite oxidizing agent is known to produce similar results as hypochlorite.

Hypochlorite oxidation is catalyzed by the presence of bromide ions. Since silver halide emulsions are conventionally precipitated in the presence of a stoichiometric excess of the halide to avoid inadvertent silver ion reduction (fogging), it is conventional practice to have bromide ions in the dispersing media of high bromide silver halide emulsions. Thus, it is specifically contemplated to add bromide ion to the starch prior to performing the oxidation step in the concentrations known to be useful in the high bromide {111} tabular grain emulsions—e.g., up to a pBr of 3.0.

Cescato U.S. Pat. No. 3,706,584 discloses techniques for the hypochlorite oxidation of cationic starch. Sodium bromite, sodium chlorite, and calcium hypochlorite are named as alternatives to sodium hypochlorite. Further teachings of the hypochlorite oxidation of starches is provided by the following: R. L. Whistler, E. G. Linke and S. Kazeniac, "Action of Alkaline Hypochlorite on Corn Starch Amylose and Methyl 4-O-Methyl-D-glucopyranosides", *Journal Amer. Chem. Soc.*, Vol. 78, pp. 4704–4709 (1956); R. L. Whistler and R. Schweiger, "Oxidation of Amylopectin with Hypochlorite at Different Hydrogen Ion Concentrations, *Journal Amer. Chem. Soc.*, Vol. 79, pp. 6460–6464 (1957); J. Schmorak, D. Mejzler and M. Lewin, "A Kinetic Study of the Mild Oxidation of Wheat Starch by Sodium Hypochloride in the Alkaline pH Range", *Journal of Polymer Science*, Vol. XLIX, pp. 203–216 (1961); J. Schmorak and M. Lewin, "The Chemical and Physico-chemical Properties of Wheat Starch with Alkaline Sodium Hypochlorite", *Journal of Polymer Science: Part A*, Vol. 1, pp. 2601–2620 (1963); K. F. Patel, H. U. Mehta and H. C. Srivastava, "Kinetics and Mechanism of Oxidation of Starch with Sodium Hypochlorite", *Journal of Applied Polymer Science*, Vol. 18, pp. 389–399 (1974); R. L. Whistler, J. N. Bemiller and E. F. Paschall, *Starch: Chemistry and Technology*, Chapter X, Starch Derivatives: Production and Uses, II. Hypochlorite-Oxidized Starches, pp. 315–323, Academic Press, 1984; and O. B. Wurzburg, *Modified Starches: Properties and Uses*, III. Oxidized or Hypochlorite-Modified Starches, pp. 23–28 and pp. 245–246, CRC Press (1986). Although hypochlorite oxidation is normally carried out using a soluble salt, the free acid can alternatively be employed, as illustrated by M. E. McKillican and C. B. Purves, "Estimation of Carboxyl, Aldehyde and Ketone Groups in Hypochlorous Acid Oxystarches", *Can. J. Chem.*, Vol. 312–321 (1954).

Periodate oxidizing agents are of particular interest, since they are known to be highly selective. The periodate oxidizing agents produce starch dialdehydes by the reaction shown in the formula (II) above without significant oxidation at the site of the 6-position carbon atom. Unlike hypochlorite oxidation, periodate oxidation does not produce carboxyl groups and does not produce oxidation at the 6-position. Mehltretter U.S. Pat. No. 3,251,826 discloses the use of periodic acid to produce a starch dialdehyde which is subsequently modified to a cationic form. Mehltretter also discloses for use as oxidizing agents the soluble salts of periodic acid and chlorine. Further teachings of the periodate oxidation of starches is provided by the following: V. C. Barry and P. W. D. Mitchell, "Properties of Periodate-oxidized Polysaccharides. Part II. The Structure of some Nitrogen-containing Polymers", *Journal Amer. Chem. Soc.*, 1953, pp. 3631–3635; P. J. Borchert and J. Mirza, "Cationic Dispersions of Dialdehyde Starch I. Theory and Preparation", *Tappi*, Vol. 47, No. 9, pp. 525–528 (1964); J. E. McCormick, "Properties of Periodate-oxidized Polysaccharides. Part VII. The Structure of Nitrogen-containing Derivatives as deduced from a Study of Monosaccharide Analogues", *Journal Amer. Chem. Soc.*, pp. 2121–2127 (1966); and O. B. Wurzburg, *Modified Starches: Properties and Uses*, III. Oxidized or Hypochlorite-Modified Starches, pp. 28–29, CRC Press (1986).

Starch oxidation by electrolysis is disclosed by F. F. Farley and R. M. Hixon, "Oxidation of Raw Starch Granules by Electrolysis in Alkaline Sodium Chloride Solution", *Ind. Eng. Chem.*, Vol. 34, pp. 677–681 (1942).

Depending upon the choice of oxidizing agents employed, one or more soluble salts may be released during the oxidation step. Where the soluble salts correspond to or are similar to those conventionally present during silver halide precipitation, the soluble salts need not be separated from the oxidized starch prior to silver halide precipitation. It is, of course, possible to separate soluble salts from the oxidized cationic starch prior to precipitation using any conventional separation technique. For example, removal of halide ion in excess of that desired to be present during grain precipitation can be undertaken. Simply decanting solute and dissolved salts from oxidized cationic starch particles is a simple alternative. Washing under conditions that do not solubilize the oxidized cationic starch is another preferred option. Even if the oxidized cationic starch is dispersed in a solute during oxidation, it can be separated using conventional ultrafiltration techniques, since there is a large molecular size separation between the oxidized cationic starch and soluble salt by-products of oxidation.

The carboxyl groups formed by oxidation take the form —C(O)OH, but, if desired, the carboxyl groups can, by further treatment, take the form —C(O)OR', where R' represents the atoms forming a salt or ester. Any organic moiety added by esterification preferably contains from 1 to 6 carbon atoms and optimally from 1 to 3 carbon atoms.

The minimum degree of oxidation contemplated is that required to reduce the viscosity of the starch. It is generally accepted (see citations above) that opening an α-D-glucopyranose ring in a starch molecule disrupts the helical configuration of the linear chain of repeating units which in turn reduces viscosity in solution. It is contemplated that at least one α-D-glucopyranose repeating unit per starch polymer, on average, be ring opened in the oxidation process. As few as two or three opened α-D-glucopyranose rings per polymer has a profound effect on the ability of the starch polymer to maintain a linear helical configuration. It is generally preferred that at least 1 percent of the glucopyranose rings be opened by oxidation.

A preferred objective is to reduce the viscosity of the cationic starch by oxidation to less than four times (400 percent of) the viscosity of water at the starch concentrations employed in silver halide precipitation. Although this viscosity reduction objective can be achieved with much lower levels of oxidation, starch oxidations of up to 90 percent of the α-D-glucopyranose repeating units have been reported (Wurzburg, cited above, p. 29). A typical convenient range of oxidation ring-opens from 3 to 50 percent of the α-D-glucopyranose rings.

The water dispersible cationic starch is present during the precipitation (during nucleation and grain growth or during grain growth) of the high bromide tabular grains. Preferably precipitation is conducted by substituting the water dispersible cationic starch for all conventional gelatino-peptizers. In substituting the selected cationic starch peptizer for conventional gelatino-peptizers, the concentrations of the selected peptizer and the point or points of addition can correspond to those employed using gelatino-peptizers.

In addition, it has been unexpectedly discovered that emulsion precipitation can tolerate even higher concentrations of the selected peptizer. For example, it has been observed that all of the selected peptizer required for the preparation of an emulsion through the step of chemical sensitization can be present in the reaction vessel prior to grain nucleation. This has the advantage that no peptizer additions need be interjected after tabular grain precipitation has commenced. It is generally preferred that from 1 to 500 grams (most preferably from 5 to 100 grams) of the selected peptizer per mole of silver to be precipitated be present in the reaction vessel prior to tabular grain nucleation.

At the other extreme it is, of course, well known, as illustrated by Mignot U.S. Pat. No. 4,334,012, that no peptizer is required to be present during grain nucleation and, if desired, addition of the selected peptizer can be deferred until grain growth has progressed to the point that peptizer is actually required to avoid tabular grain agglomeration.

The procedures for high bromide {111} tabular grain emulsion preparation through the completion of tabular grain growth require only the substitution of the selected peptizer for conventional gelatino-peptizers. The following high bromide {111} tabular grain emulsion precipitation procedures are specifically contemplated to be useful in the practice of the invention for the use of gelatin as a peptizer and for the starch peptizer modifications discussed above:

Daubendiek et al U.S. Pat. No. 4,414,310;
Abbott et al U.S. Pat. No. 4,425,426;
Wilgus et al U.S. Pat. No. 4,434,226;
Maskasky U.S. Pat. No. 4,435,501;
Kofron et al U.S. Pat. No. 4,439,520;
Solberg et al U.S. Pat. No. 4,433,048;
Evans et al U.S. Pat. No. 4,504,570;
Yamada et al U.S. Pat. No. 4,647,528;
Daubendiek et al U.S. Pat. No. 4,672,027;
Daubendiek et al U.S. Pat. No. 4,693,964;
Sugimoto et al U.S. Pat. No. 4,665,012;
Daubendiek et al U.S. Pat. No. 4,672,027;
Yamada et al U.S. Pat. No. 4,679,745;
Daubendiek et al U.S. Pat. No. 4,693,964;
Maskasky U.S. Pat. No. 4,713,320;
Nottorf U.S. Pat. No. 4,722,886;
Sugimoto U.S. Pat. No. 4,755,456;
Goda U.S. Pat. No. 4,775,617;
Saitou et al U.S. Pat. No. 4,797,354;
Ellis U.S. Pat. No. 4,801,522;
Ikeda et al U.S. Pat. No. 4,806,461;
Ohashi et al U.S. Pat. No. 4,835,095;
Makino et al U.S. Pat. No. 4,835,322;
Daubendiek et al U.S. Pat. No. 4,914,014;
Aida et al U.S. Pat. No. 4,962,015;
Ikeda et al U.S. Pat. No. 4,985,350;
Piggin et al U.S. Pat. No. 5,061,609;
Piggin et al U.S. Pat. No. 5,061,616;

Tsaur et al U.S. Pat. No. 5,147,771;
Tsaur et al U.S. Pat. No. 5,147,772;
Tsaur et al U.S. Pat. No. 5,147,773;
Tsaur et al U.S. Pat. No. 5,171,659;
Tsaur et al U.S. Pat. No. 5,210,013;
Antoniades et al U.S. Pat. No. 5,250,403;
Kim et al U.S. Pat. No. 5,272,048;
Delton U.S. Pat. No. 5,310,644;
Chang et al U.S. Pat. No. 5,314,793;
Sutton et al U.S. Pat. No. 5,334,469;
Black et al U.S. Pat. No. 5,334,495;
Chaffee et al U.S. Pat. No. 5,358,840; and
Delton U.S. Pat. No. 5,372,927.

The high bromide tabular grain imaging emulsions, preferably {111} tabular emulsions, that are formed contain at least 50 mole percent, more preferably 70 mole percent bromide, and optimally at least 90 mole percent, based on silver. Silver bromide, silver iodobromide, silver chlorobromide, silver iodochlorobromide, and silver chloroiodobromide tabular grain emulsions are specifically contemplated. Although silver chloride and silver bromide form tabular grains in all proportions, chloride is preferably present in concentrations of 30 mole percent, based on silver, or less. Iodide can be present in the tabular grains up to its solubility limit under the conditions selected for tabular grain precipitation. Under ordinary conditions of precipitation silver iodide can be incorporated into the tabular grains in concentrations ranging up to about 40 mole percent, based on silver. It is generally preferred that the iodide concentration be less than 20 mole percent, based on silver. Typically the iodide concentration is less than 10 mole percent, based on silver, and more preferably less than 6 mole percent, based on silver. To facilitate rapid processing, such as commonly practiced in radiography, it is preferred that the iodide concentration be limited to less than 4 mole percent, based on silver. Significant photographic advantages can be realized with iodide concentrations as low as 0.5 mole percent, based on silver, with an iodide concentration of at least 1 mole percent, based on silver, being preferred.

High bromide {111} tabular grain emulsions precipitated in the presence of a cationic starch are disclosed in the following patents: Maskasky U.S. Pat. Nos. 5,604,085; 5,620,840; 5,667,955; 5,691,131; and 5,733,718.

As noted above, one method of preparing a "low fogging" emulsion is wherein the majority (i.e., at least 50 mole percent) of grain growth during emulsion grain precipitation in the reaction vessel, and preferably precipitation of greater than 70 mole % (more preferably greater than 90 mole %) of the emulsion grains based on total silver, is performed at a relatively low pH of less than 4.0, preferably less than or equal to 3.5, more preferably less than or equal to 3.0. This low pH precipitation method may be used with either conventional gelatin peptizers or with starch peptizers. Preferably it is utilized with starch peptizers. While the use of a low pH environment with starch peptizers during grain growth may result in starch hydrolysis leading to the formation of additional aldehyde groups (which are believed to reduce silver ions to generate fog silver centers in emulsion grains), growth of high bromide silver halide emulsion grains at low pH in the presence of a starch peptizer has surprisingly resulted in fewer fog generating grains, even in the absence of use of a strong oxidizing agent during emulsion grain precipitation as was previously thought required to oxidize silver fog centers as they are formed. Maintenance of a low pH environment during grain growth in accordance with the invention is believed to sufficiently suppress the silver ion reduction reaction such that silver centers are not formed at photographically harmful levels, leading to low fog emulsions. As such, in accordance with preferred embodiments of the invention, the addition or generation of strong oxidizing agents in the reaction vessel during grain growth is not needed. While establishing a relatively low pH value is advantageous during grain growth, extremely low pH would be expected to degrade the starch peptizer; therefore, a pH value of at least 1.0 is also preferred. Methods of preparing silver bromide emulsions under low pH conditions are described in U.S. Pat. Nos. 6,383,730 6,395,465, the disclosures of which are incorporated herein by reference.

The second method of preparing "low fogging" emulsions is utilized with starch peptized emulsions. In this method the emulsion is treated with an oxidizing agent, which is capable of oxidizing metallic silver, during or subsequent to grain precipitation. Preferred oxidizing agents are those that in their reduced form have little or no impact on the performance properties of the emulsions in which they are incorporated. Strong oxidizing agents such as those noted above to be useful in oxidizing cationic starch, such as hypochlorite ($ClO^-$) or periodate ($IO_4^-$), are specifically contemplated. Specifically preferred oxidizing agents are halogen—e.g., bromine ($Br_2$) or iodine ($I_2$). When bromine or iodine is used as an oxidizing agent, the bromine or iodine is reduced to $Br^-$ or $I^-$. These halide ions can remain with other excess halide ions in the dispersing medium of the emulsion or be incorporated within the grains without adversely influencing photographic performance. Any level of oxidizing agent can be utilized that is effective in reducing minimum density. Concentrations of oxidizing agent added to the emulsion as low as about $1\times10^{-6}$ mole per Ag mole are contemplated. Since very low levels of $Ag^o$ are responsible for increases in minimum density, no useful purpose is served by employing oxidizing agent concentrations of greater than 0.1 mole per Ag mole. A specifically preferred oxidizing agent range is from $1\times10^{-4}$ to $1\times10^{-2}$ mole per Ag mole. The silver basis is the total silver at the conclusion of precipitation of the high bromide {111} tabular grain emulsion, regardless of whether the oxidizing agent is added during or after precipitation.

Conventional dopants can be incorporated into the tabular grains during their precipitation, as illustrated by the patents cited above and *Research Disclosure*, Item 38957, Section I. Emulsion grains and their preparation, D. Grain modifying conditions and adjustments, paragraphs (3), (4) and (5). It is specifically contemplated to incorporate shallow electron trapping (SET) site providing dopants in the tabular grains, further disclosed in *Research Disclosure*, Vol. 367, November 1994, Item 36736, and Olm et al U.S. Pat. No. 5,576,171.

It is also recognized that silver salts can be epitaxially grown onto the tabular grains during the precipitation process. Epitaxial deposition onto the edges and/or corners of tabular grains is specifically taught by Maskasky U.S. Pat. No. 4,435,501 and Daubendiek et al U.S. Pat. Nos. 5,573,902 and 5,576,168.

Although epitaxy onto the host tabular grains can itself act as a sensitizer, the emulsions of the invention show sensitivity enhancements with or without epitaxy when chemically sensitized employing one or a combination of noble metal, middle chalcogen (sulfur, selenium and/or tellurium) and reduction chemical sensitization techniques. Conventional chemical sensitizations by these techniques are summarized in *Research Disclosure*, Item 38957, cited above, Section IV. Chemical sensitizations. It is preferred to employ at least one of noble metal (typically gold) and middle chalcogen (typically sulfur) and, most preferably, a combination of both in preparing the emulsions of the invention for photographic use. The use of a cationic starch peptizer allows distinct advantages relating to chemical sensitization to be realized. Under comparable levels of chemical sensitization higher photographic speeds can be realized using cationic starch peptizers. When comparable photographic speeds are sought, a cationic starch peptizer in the absence of gelatin allows lower levels of chemical sensitizers to be employed and results in better incubation keeping. When chemical sensitizer levels remain unchanged, speeds equal to those obtained using gelatino-peptizers can be achieved at lower precipitation and/or sensitization temperatures, thereby avoiding unwanted grain ripening.

Between emulsion precipitation and chemical sensitization, the step that is preferably completed before any gelatin or gelatin derivative is added to the emulsion, it is conventional practice to wash the emulsions to remove soluble reaction by-products (e.g., alkali and/or alkaline earth cations and nitrate anions). If desired, emulsion washing can be combined with emulsion precipitation, using ultrafiltration during precipitation as taught by Mignot U.S. Pat. No. 4,334,012. Alternatively emulsion washing by diafiltration after precipitation and before chemical sensitization can be undertaken with a semipermeable membrane as illustrated by *Research Disclosure*, Vol. 102, October 1972, Item 10208; Hagemaier et al *Research Disclosure*, Vol. 131, March 1975, Item 13122; Bonnet *Research Disclosure*, Vol. 135, July 1975, Item 13577; Berg et al German OLS 2,436,461 and Bolton U.S. Pat. No. 2,495,918, or by employing an ion-exchange resin, as illustrated by Maley U.S. Pat. No. 3,782,953 and Noble U.S. Pat. No. 2,827,428. In washing by these techniques there is no possibility of removing the selected peptizers, since ion removal is inherently limited to removing much lower molecular weight solute ions.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known Kodak C-41 color process as described in The British Journal of Photography Annual of 1988, pages 191–198, and other known color negative film processes such as the Kodak ECN-2 process described in the H-24 Manual available from Eastman Kodak Co. Where applicable, the element may be processed in accordance with color print processes such as the RA-4 process of Eastman Kodak Company as described in the British Journal of Photography Annual of 1988, Pp 198–199. Such negative working emulsions are typically sold with instructions to process using a color negative method such as the mentioned C-41, ECN, or RA-4 processes.

Preferred color developing agents are p-phenylenediamines such as:

- 4-amino-N,N-diethylaniline hydrochloride,
- 4-amino-3-methyl-N,N-diethylaniline hydrochloride,
- 4-amino-3-methyl-N-ethyl-N-(2-methanesulfonamido-ethyl)aniline sesquisulfate hydrate,
- 4-amino-3-methyl-N-ethyl-N-(2-hydroxyethyl)aniline sulfate,
- 4-amino-3-(2-methanesulfonamido-ethyl)-N,N-diethylaniline hydrochloride and
- 4-amino-N-ethyl-N-(2-methoxyethyl)-m-toluidine di-p-toluene sulfonic acid.

Development is usually followed by the conventional steps of bleaching, fixing, or bleach-fixing to remove silver or silver halide, washing, and drying.

The following examples are intended to illustrate, but not to limit the invention.

EXAMPLES

Photographic Example

Photographic samples demonstrating the principles of this invention were produced as follows: (coverage are in grams per meter squared, emulsion sizes as determined by the disc centrifuge method and are reported in Diameter×Thickness in micrometers). Surfactants, coating aids, emulsion addenda, sequestrants, thickeners, lubricants, matte and tinting dyes were added to the appropriate layers as is common in the art. Laydowns and composition of the samples are listed in Table 1.

| | |
|---|---|
| Overcoat | 2.70 Gelatin |
| | 0.20 Bis-vinylsulfonylmethylether hardener |
| Emulsion Layer: | 3.24 Gelatin |
| | 0.807 Silver Halide Emulsion (as specified in Table) |
| | Fogged grain emulsion (as specified in Table) |
| | 0.324 Cyan Coupler C-l (dispersed in its own weight of di-N-butyl sebacate) |
| | 0.162 ETARC (dispersed in twice its own weight di-N-butyl sebacate) |
| | 0.012 DARC (dispersed in twice its own weight of tricresyl phosphate) |
| Support | Cellulose Acetate subbed with 4.90 Gelatin with RemJet backing |

Preparation of fine fogged grain emulsion A reaction vessel was charged with 10.9 L of distilled water and maintained at 36° C. This was an isothermal precipitation and thus the entire reaction was maintained at this temperature. To this vessel were added enough NaBr to bring the concentration to 3.6 millimolar and enough gelatin to make its concentration 1.89659 weight percent. A double jet nucleation initiated the precipitation via the addition of 1.42M $AgNO_3$ added concurrently with a salt solution that was 1.3788 M NaBr and 0.04786 M KI while the pBr was at 2.53. During the nucleation segment 1.25% of the final yield of emulsion was precipitated over a period of 0.376 min. Nucleation was followed by the first of three growth segments (all employing the same silver and salts solutions previously used) in which the pBr was now 2.56 and 8.32 percent of the reaction was completed over a duration of 2.5 min. The second growth segment extended over a 3-minute time interval during which the pBr was ramped from 2.56 to 3.9 and an additional 10 percent of the reaction was completed. The third and final growth segment occurred over a 24.16 minute time interval in which the pBr was maintained at 3.9 and the remaining 80.43 percent of the reaction occurred. The emulsion was iso-washed and adjusted to a pBr of 3.39 and to a final pH of 5.6. This precipitated fogged fine grain emulsion was cubic and measured 0.069 $\mu$m on an edge, had a surface area of 2522 $m^2$/mole, and contained 3.34 mole percent iodide (96.65% bromide). It was chemically fogged using thioureadioxide (aminoiminomethanesulfinic acid).

Emulsion A: A silver bromoiodide tabular grain emulsion was made using procedures generally described in U.S. Pat. No. 6,159,676, Example A, incorporated herein by reference, except that the temperature was 59° C., the double jet addition was temporarily halted after 41 minutes when 68% of the Ag had been added, and an amount of AgI seeds corresponding to 3.7% of the total Ag was added. The amount of base, ammonium sulfate, and acid were also adjusted as known in the art to produce the desired size and thickness of 4.2×0.126 with an overall iodide content of 3.7%. This raw emulsion was then sensitized using procedures described in U.S. Pat. No. 6,159,676, Example B2C, except that three dyes were added: SD-1 at 0.05 millimole/mole Ag, SD-2 at 0.475 millimole/mole Ag, and SD-3 at 0.474 millimole/mole Ag. After adding a thiourea sensitizer and a Au(+1) sensitizer, the emulsion was heated for 5 minutes at 65° C., cooled, and 12 mg of antifoggant AF-1 per mole Ag was added. When tested in the appropriate format with C-1, Emulsion A has an intrinsic fog level of 0.043. The structures of the additives are as follows.

SD-1

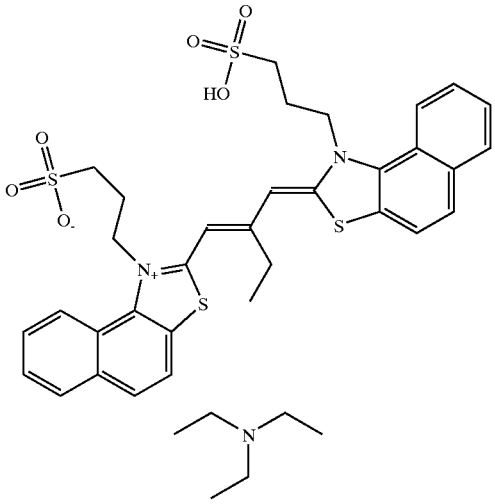

SD-2

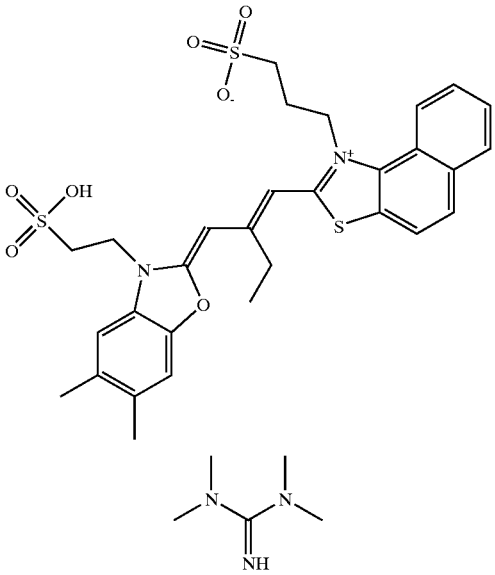

-continued

SD-3

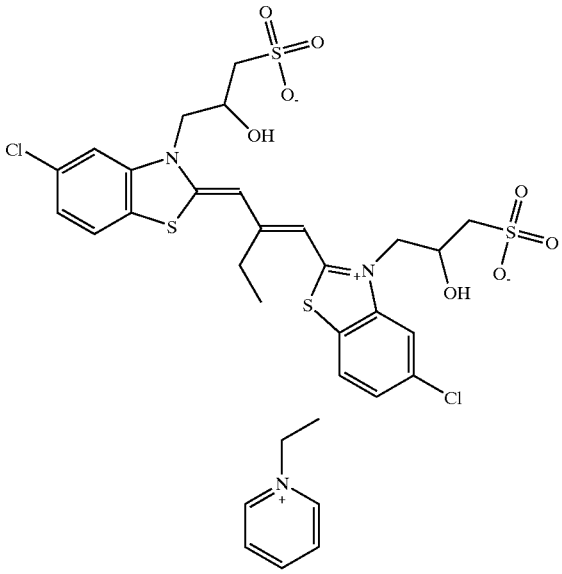

AF-1

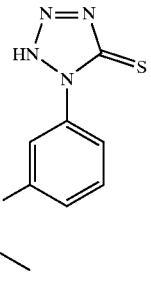

Emulsion B: Emulsion B was prepared using the same raw emulsion and was sensitized as for A above except that the elevated temperature hold was 7 minutes at 60° C., and additional antifoggant AF-1 was added, totaling 45 mg per mole of Ag. When tested in the appropriate format with C-1, emulsion B had an intrinsic fog level of 0.033.

Emulsion C: An AgBrI tabular silver halide emulsion was prepared containing 3.8% total iodide distributed such that the central portion of the emulsion grains contained no iodide and the perimeter area contained substantially higher iodide as described by Fenton et al U.S. Pat. No. 5,476,760, incorporated herein by reference. Unlike the emulsions described by Fenton et al, the inventive emulsions described below did not contain the pluronic surfactant, nor use gelatin as a peptizer.

A starch solution was prepared by heating at 85° C. for 45 min. a stirred mixture of 5.4 L distilled water and 127 g of an oxidized cationic waxy cornstarch. The starch derivative, STA-LOK® 140, is 100% amylopectin that had been treated to contain quaternary ammonium groups and oxidized with 2 wt % chlorine bleach. It contains 0.31 wt % nitrogen and 0.00 wt % phosphorous. It was obtained from A. E. Staley Manufacturing Co., Decatur, Ill. After cooling to 40° C., the weight was adjusted to 8.0 kg with distilled water, 21.2 mL of a 2 M NaBr solution was added, then while maintaining the pH at 5.0, 1.6 mL of saturated bromine water (~0.72 mmole) was added dropwise just prior to use.

To a vigorously stirred reaction vessel of the starch solution at 40° C. and maintained at pH 3.0 throughout the emulsion precipitation, a 2.5 M $AgNO_3$ solution was added at 78.2 mL per min for 60 sec. Concurrently, a 2.5 M NaBr salt solution was added initially at 78.2 mL per min. and then at a rate needed to maintain a pBr of 1.87. Then the addition of the silver solution was stopped while the salt solution was run until the pBr was brought down to a value of 1.52. The temperature of the contents of the reaction vessel was then increased to 70° C. at a rate of 1.67° C. per min. After holding at 70° C. for 1 min, additional treated starch equal to one half the initial reactor charge was introduced to the reaction vessel. The pBr was readjusted upwards to 1.82 with the silver nitrate solution. A 15 minute constant flow growth segment (7.6 mL per min) was then initiated at this pBr such that 4.7% of the final emulsion was precipitated. The pBr was then lowered to 1.72 with salt solution and a 66 minute growth segment ensued with salt solution controlling at this pBr and silver solution increasing from 11.4 to 63.4 mL per minute. At the end of this segment, ⅔ of the total emulsion had been precipitated.

The silver nitrate solution flow was stopped and a second salt solution containing 0.4 M NaBr and 0.44 M KI was pumped to the reaction vessel over a period of 18 minutes, during which time the pBr was lowered to 1.07. $K_4Fe(CN)_6$ was introduced over a period of 2 min. at a concentration of 36 molar parts per million (bulk). The pBr was then raised to a value of 2.75 by flowing only silver nitrate solution. Once this pBr was reached, 80% of the precipitation was complete and a double jet introduction of salts and silver continued for 17 minutes during which time the remainder of the emulsion was precipitated. The resulting tabular grain emulsion was washed by ultrafiltration at 40° C. to a pBr of 3.36. Then 27 g of bone gelatin (methionine content 55 micromole per g gelatin) per mole silver was added. The {111} tabular grains had an average equivalent circular diameter of 3.43 μm, an average thickness of 0.124 μm, and an average aspect ratio of 28.

The following chemicals (amount per mole silver) were added to the invention emulsion with stirring at 40° C.: 1,3-Benzenedisulfonic acid, 4,5-dihydroxy-, disodium salt (1.827 g), NaSCN (100 mg or 1.23 mmole), (3-{3-[(methylsulfonyl)amino]-3-oxopropyl} benzothiazolium tetrafluoroborate (35 mg or 0.094 mmole), SD-1 (30.5 mg or 0.039 mmole), spectral sensitizing dye D-2 (287.3 mg or 0.386 mmole) and SD-3 (288.3 mg or 0.368 mmole), 1,3-dicarboxymethyl-1,3-dimethyl-2-thiourea (1.98 mg or 0.01 mmole), the tripotassium salt of bis-N-(3-(2-sulfobenzamido)phenylmercaptotetrazole aurate (3.85 mg or 0.0033 mmole). The emulsion was then heated at 65° C. for 15 minutes, cooled to 40° C., then sequentially; AF-1 (30 mg or 0.1275 mmole), and 4-hydroxy-6-methyl-1,3,3a,7-tetraazaindene (1.05 gm) were added. Emulsion C has an intrinsic fog level of 0.022.

These films were given a stepped exposure and processed in the KODAK FLEXICOLOR™ (C-41) process as described in *British Journal of Photography Annual*, 1988, pp 196–198 except the time of development was 2.5 minutes for all samples. Dmin is the minimum optical density measured in an unexposed region of the film. Speed is reported in relative log units, where a speed difference of 1 relative log speed difference is equal to an exposure difference of 0.01 log E, where E represents an exposure (measured in lux-seconds). Speed is calculated as 100(1−logH) where H is the minimum exposure in lux-seconds determined at the intersection point of the linear straight-line portion of the response curve and the horizontal line drawn at Dmin. Relative red speed was determined by comparing the speed of the test sample to the check position without the fogged grains.

Granularity is reported as the logarithm of the noise equivalent quanta or log NEQ (J. C. Dainty and R. Shaw "Image Science", 1974). It is a metric used here to characterize the entire exposure range of the film. To calculate the log NEQ of a coated emulsion, the granularity of the processed coating is first determined by the RMS method (see The Theory of the Photographic Process, $4^{th}$ Edition, T. H. James, pp 625–628) using a 48 μm aperture. RMS Granularity is the root-mean-squared standard deviation or local density variation in an area of overall uniform density. The rms granularity is determined for each exposure step and is then divided into the instantaneous contrast of that step. This dividend, squared and summed for all exposure steps, is proportional to the noise equivalent quanta of the coated film. This number is also in the same relative log units as speed, the larger the number, the lower (i.e., better) the granularity of the film. Relative red granularity was determined by comparing the log NEQ of the test sample to the check position without the fogged grains. As speed and granularity are calculated in the same relative log units, they can be added together to derive a "speed-grain" efficiency number for the coating. The more positive the number, the more efficient the emulsion, the better is its speed-grain position.

Results are listed in Table 1.

Regardless of the nature of the emulsion substrate, "normal" (A), low fogging (by virtue of finish variations, B) or else low fogging (by virtue of low pH precipitation, C) the presence of a low level of prefogged fines enhances the ETARC plus DARC combination by respectively: 5 units or 0.05 log E (12%), 8 units or 0.08 log E (20%) or else 6 units or 0.06 log E (15%).

TABLE 1

| Sample | Comparison or Invention | ETARC | DARC | FOGGED FINES | Red Dmin | Relative Red Speed | Relative Red Grain | Relative Red Speed-Grain |
|---|---|---|---|---|---|---|---|---|
| 1 Em A | Comp | — | — | — | 0.08 | 100 | 0 | 100 |
| 2 Em A | Comp | E-2 | D-14 | — | 0.1 | 111 | −4 | 107 |
| 3 Em A | Inv | E-2 | D-14 | 1.08 mg/m$^2$ | 0.17 | 110 | +2 | 112 |
| 4 Em B | Comp | — | — | — | 0.05 | 100 | 0 | 100 |
| 5 Em B | Comp | E-2 | D-14 | — | 0.07 | 115 | −9 | 106 |
| 6 Em B | Inv | E-2 | D-14 | 1.08 mg/m$^2$ | 0.1 | 122 | −8 | 114 |
| 7 Em C | Comp | — | — | — | 0.06 | 100 | 0 | 100 |
| 8 Em C | Comp | E-2 | D-14 | — | 0.14 | 127 | −21 | 106 |
| 9 Em C | Inv | E-2 | D-14 | 0.81 mg/m$^2$ | 0.14 | 110 | 02 | 112 |

The results in Table 1 also clearly demonstrate that low fog emulsions are particularly useful with the combination of the invention. This indicates that the usefulness of the inventive combination is greatest when used in combination with "clean" emulsions that have a low level of intrinsic fog (in these red light sensitive examples, an intrinsic fog of 0.034 or less).

The invention has been described in detail with particular reference to certain preferred embodiments thereof, but it will be understood that variations and modifications can be effected within the spirit and scope of the invention.

What is claimed is:

1. A negative silver halide photographic element comprising a support and a silver halide imaging layer containing a light sensitive silver halide imaging emulsion, said silver halide imaging layer further comprising a separately precipitated non-imaging intentionally fogged fine grain emulsion, an electron transfer agent releasing compound represented by formula (I) and a development accelerator releasing compound represented by formula (II):

$$CAR^1\text{-}(L)_n\text{-}ETA \quad (I)$$

wherein:

$CAR^1$ is a carrier moiety which is capable of releasing -(L)n-ETA on reaction with oxidized developing agent;

L is a divalent linking group, n is 0, 1 or 2; and

ETA is a releasable electron transfer agent;

$$CAR^2\text{—}(SAM)\text{-}NX^1\text{—}NX^2X^3 \quad (II)$$

wherein:

$CAR^2$ is a carrier moiety which is capable of releasing —(SAM)-$NX^1$—$NX^2X^3$ on reaction with oxidized developing agent;

SAM is a silver absorbable moiety attached to the carrier moiety and is released on reaction with oxidized development agent; and —$NX^1$—$NX^2X^3$ is a hydrazine group wherein $X^1$, $X^2$ and $X^3$ are individually hydrogen or a substituent chosen from alkyl, aryl, carbonyl or sulfonyl groups with the proviso that at least one of $X^1$, $X^2$ and $X^3$ is hydrogen.

2. The negative silver halide photographic element of claim 1 wherein ETA is a releasable 1-aryl-3-pyrazolidinone electron transfer agent having a calculated log partition coefficient (c log P) greater than or equal to 2.40 and the total sum of the Hammett sigma(para) values of the substituents on the 1-aryl ring is 0.51 or less, the ETA being bonded to L or $CAR^1$ through either the nitrogen atom in the 2-position or the oxygen attached to the 3-position of the pyrazolidinone ring.

3. The negative silver halide photographic element of claim 1 in which the electron transfer releasing compound has a c log P equal to or greater than 2.40 and equal to or less than 3.40.

4. The negative silver halide photographic element of claim 1 wherein ETA is represented by formula Ia or Ib:

Ia

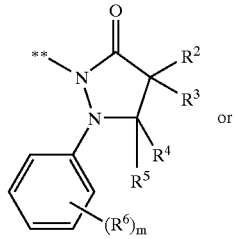

or

Ib

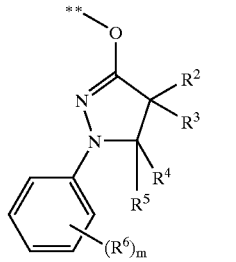

**denotes point of attachment to $CAR^1$—$(L)_n$—;

wherein:

$R^2$ and $R^3$ each independently represents hydrogen, a substituted or unsubstituted alkyl group having from 1 to 12 carbon atoms, $CH_2OR^7$ or $CH_2OC(O)R^7$ where $R^7$ is a substituted or unsubstituted alkyl, aryl or a heteroatom containing group;

$R^4$ and $R^5$ each independently represents hydrogen, a substituted or unsubstituted alkyl group having from 1 to 8 carbon atoms, or a substituted or unsubstituted aryl group having from 6 to 10 carbon atoms;

$R^6$ is a substituent; and m is 0 to 5; wherein when m is greater than 1, the $R^6$ substituents may form a carbocyclic or heterocyclic ring providing that the sum total of all of the $R^6$ substituents is 0.51 or less.

5. The negative silver halide photographic element of claim 4 wherein $R^2$ and $R^3$ are alkyl, $CH_2OR^7$ or $CH_2OC(O)R^7$ groups containing 3 to 8 carbon atoms; $R^4$ and $R^5$ are hydrogen, $R^6$ is independently a halogen, a substituted or unsubstituted alkyl group having from 1 to 8 carbon atoms, a substituted or unsubstituted alkoxy group having from 1 to 8 carbon atoms, an amido, sulfonamido, ester, cyano, sulfone, carbamoyl, ureido group, or a heteroatom containing group or ring.

6. The negative silver halide photographic element of claim 1 wherein the non-imaging fine fogged grain silver halide emulsion has an average mean particle size of less than 0.5 $\mu$m.

7. The negative silver halide photographic element of claim 1 wherein the non-imaging fine fogged grain silver halide emulsion has an average mean particle size of less than 0.2 $\mu$m.

8. The negative silver halide photographic element of claim 1 wherein the amount of the non-imaging fine fogged grain silver halide emulsion contained in the imaging layer is between 0.05% to 0.5% by weight of the imaging silver halide emulsion.

9. The negative silver halide photographic element of claim (1) wherein $CAR^1$ and $CAR^2$ are both phenol or naphthol coupler moieties.

10. The negative silver halide photographic element of claim 1 wherein the silver halide imaging layer is sensitive to red light.

11. The negative silver halide photographic element of claim 10 where the red light sensitive layer has two or more layers of differing sensitivity to red light and the fine fogged grain emulsion and the electron transfer agent releasing compound are contained in the layer which is the most red light sensitive layer.

12. The negative silver halide photographic element of claim 11 where the red light sensitive layer has two or more layers of differing sensitivity to red light and the fine fogged grain emulsion, the electron transfer agent releasing compound, and the development accelerator releasing compound are contained in the layer which is the most red light sensitive layer.

13. The negative silver halide photographic element of claim (1) wherein the electron transfer agent releasing compound is contained in the silver halide imaging layer at a concentration from 6 $\mu$mole/m$^2$ to 1000 $\mu$mole/m$^2$, and the development accelerator releasing compound is contained in the silver halide imaging layer at a concentration from 0.1 $\mu$mole/m$^2$ to 25 $\mu$mole/m$^2$.

14. The negative silver halide photographic element of claim 13 wherein the electron transfer agent releasing compound is contained in the silver halide imaging layer at a concentration from 20 $\mu$mole/m$^2$ to 140 $\mu$mole/m$^2$, and the development accelerator releasing compound is contained in the silver halide imaging layer at a concentration from 0.5 $\mu$mole/m$^2$ to 10 $\mu$mole/m$^2$.

15. The negative silver halide photographic element of claim 1 wherein the silver halide imaging layer further comprises an image dye-forming coupler compound.

16. The negative silver halide photographic element of claim (1) wherein the SAM moiety of the development accelerator releasing compound is a nitrogen containing heterocycle with at least one N—H in its released form according to formula SAM-1:

SAM-1

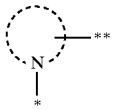

wherein the dashed line represents the atoms necessary to form a heterocyclic ring, * denotes the site of attachment to CAR$^2$ and ** denotes the site of attachment to the hydrazine group.

17. The negative silver halide photographic element of claim 16 wherein the nitrogen heterocycle represented by SAM-1 is a benzotriazole, triazole, tetrazole, or tetraazaindene.

18. The negative silver halide photographic element of claim (1) wherein the SAM moiety of the development accelerator releasing compound is a sulfur atom.

19. The negative silver halide photographic element of claim (1) wherein the SAM moiety is a heterocycle with a free —SH (or its tautomeric equivalent) in its released form according to formula SAM-2,

SAM-2

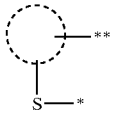

wherein the dashed line represents the atoms necessary to form a heterocyclic ring, * denotes the site of attachment to CAR$^2$ and ** denotes the site of attachment to the hydrazine group.

20. The negative silver halide photographic element of claim 19 wherein the thiol substituted heterocycle represented by SAM-2 is a mercaptotetrazole, mercaptotriazole, mercaptothiadiazole, mercaptooxadiazole, mercaptotetraazindene or mercaptobenzoxazine.

21. The negative silver halide photographic element of claim (1) wherein $X^1$ and $X^2$ of the development accelerator releasing compound is individually hydrogen or an acyl or alkoxycarbonyl group containing 1 to 6 carbon atoms, and $X^3$ is an acyl group, a thioacyl group, a carbamoyl group, an alkyloxycarbonyl group, an aryloxycarbonyl group, an oxalate or oxalate ester group, an oxalamido group, a sulfonyl group or a sulfamoyl group, each of which may contain 1 to 7 carbon atoms.

22. The negative silver halide photographic element of claim 1 wherein the negative silver halide photographic element further comprises a masking coupler.

23. The negative silver halide photographic element of claim 1 wherein the negative silver halide photographic element further comprises a development inhibitor releasing coupler.

24. The negative silver halide photographic element of claim 1 wherein the negative silver halide photographic element further comprises printed instructions to process the element using a color negative method.

25. The negative silver halide photographic element of claim 1 wherein the silver halide imaging emulsion comprises low fogging silver halide grains.

26. The negative silver halide photographic element of claim 25 wherein the low fogging silver halide grains are tabular silver iodobromide grains.

27. The negative silver halide photographic element of claim 26 wherein the silver halide emulsion containing the low fogging tabular silver halide grains has been precipitated in a reaction vessel and the majority of grain growth in the reaction vessel was performed at a pH of less than 4.0.

28. The negative silver halide photographic element of claim 26 wherein the silver halide emulsion containing low fogging tabular silver halide grains has been precipitated in an aqueous medium containing a peptizer that is a water dispersible starch.

29. The negative silver halide photographic element of claim 28 wherein the starch peptized silver halide emulsion containing low fogging tabular silver halide grains has additionally been precipitated in the presence of an oxidizing agent capable of oxidizing metallic silver.

30. The negative silver halide photographic element of claim 28 wherein the starch peptized silver halide emulsion containing low fogging tabular silver halide grains has been precipitated in a reaction vessel and the majority of grain growth in the reaction vessel was performed at a pH of less than 4.0.

31. The negative silver halide photographic element of claim 26 wherein the silver halide imaging emulsion has maximum sensitivity to blue light and an intrinsic fog level of 0.037 or less.

32. The negative silver halide photographic element of claim 26 wherein the silver halide imaging emulsion has maximum sensitivity to green light and an intrinsic fog level of 0.048 or less.

33. The negative silver halide photographic element of claim 26 wherein the silver halide imaging emulsion has maximum sensitivity to red light and an intrinsic fog level of 0.034 or less.

* * * * *